US006067780A

United States Patent [19]

Gentili et al.

[11] Patent Number: 6,067,780

[45] Date of Patent: May 30, 2000

[54] AUTOMATIC PACKAGING MACHINE FOR PACKAGING PRODUCTS

[75] Inventors: Giovanni Gentili; Maria Gioia Grandi, both of Bologna, Italy

[73] Assignee: T.M.C. S.p.A., Bologna, Italy

[21] Appl. No.: 09/222,415

[22] Filed: Dec. 29, 1998

[30] Foreign Application Priority Data

Dec. 30, 1997 [IT] Italy ..... BO97A0745
Mar. 12, 1998 [IT] Italy ..... BO98A0149

[51] Int. Cl.[7] ..... B65B 11/22; B65B 59/00

[52] U.S. Cl. ..... 53/504; 53/230; 53/231; 53/375.9; 53/376.2

[58] Field of Search ..... 53/504, 231, 230, 53/228, 233, 232, 371.3, 375.9, 376.2, 466, 461

[56] References Cited

U.S. PATENT DOCUMENTS

| | | | |
|---|---|---|---|
| 2,153,483 | 4/1939 | Rose | 53/231 |
| 3,722,175 | 3/1973 | Maulini et al. | 53/230 X |
| 4,137,691 | 2/1979 | Takahashi | 53/230 X |
| 4,313,290 | 2/1982 | Furuya et al. | 53/230 |
| 5,038,549 | 8/1991 | Nordstrom | 53/230 X |
| 5,157,903 | 10/1992 | Nakashima et al. | 53/504 |
| 5,437,144 | 8/1995 | Akiyama et al. | 53/466 |

*Primary Examiner*—James F. Coan
*Attorney, Agent, or Firm*—Fay, Sharpe, Fagan, Minnich & McKee

[57] ABSTRACT

An automatic packaging machine for packaging products into packs comprises: a wrapper forming line along which there is a succession of at least three operating stations positioned above a sliding surface along which the products are fed with a stepping motion by mobile pusher elements. The forming line co-operates with a lift located below the product sliding surface and vertically and alternately mobile between a lowered level, at which it receives products on its loading table, and a raised level, at which it places the products on the sliding surface of the forming line, feeding them between the pusher elements with a sheet of wrapping material laid on top of the products. The machine comprises adjustment means for a product feed line, the wrapper forming line, the operating stations and the pusher elements. The adjustment means are connected to the machine centralized control means and are designed to refer the machine adjustments necessary for variations in the size of the pack to the product sliding surface.

49 Claims, 22 Drawing Sheets

AUTOMATIC PACKAGING MACHINE FOR PACKAGING PRODUCTS

BACKGROUND OF THE INVENTION

The present invention relates to packaging machines, in particular, automatic packaging machines for packaging products such as rolls of paper, holding them together in the form of a pack, using a sheet of wrapping material which is wound and folded around the product and sealed over itself.

In packaging machines of the above-mentioned type, packaging is effected by feeding the individual products or groups of products one after another along a forming line, on which the products, between pusher elements at stepped intervals and mobile along the forming line, move forward with intermittent motion, passing through a series of operating stations, in which packaging is effected.

The operating stations respectively envisage: the infeed into the machine of products topped by a sheet of wrapping material, for example a plastic film; winding of the sheet of wrapping material around the products and overlapping of the opposite edges of said material underneath the products; the formation on the sheet of wrapping material of two pairs of first, vertical flaps, folded against the products; the formation of two pairs of second flaps; sealing of the edges of the sheet of wrapping material underneath the pack; folding of the pairs of second flaps against the pack and, finally, sealing of the pack by sealing the flaps to the sheet of wrapping material.

The present invention concerns, in particular, an automatic machine, of the above-mentioned type and corresponding with the preamble to claim 1, for effecting the above-mentioned product packaging.

The machine comprises a forming line for the wrapper, along which the three operating stations are arranged one after another above a sliding surface for the products, which are fed with a stepping motion along the surface by the mobile pushers. The first operating station of the forming line co-operates with a lift, located below the product sliding surface and vertically and alternately mobile between a lower level, at which it receives the products on its loading table, and a raised level, at which it places the products on the forming line sliding surface and inserts them between the pusher elements with a sheet of wrapping material laid on top of them. The sheet hangs down on both sides of the pack, with its vertical folds positioned between the products and the pusher elements. The first operating station also comprises a horizontal-plane folder and counter-folder, located below the sliding surface and on either side of the lift. The folder and counter-folder are alternately mobile parallel with the product sliding surface, from a first, open end position, in which they allow the lift loading table to move freely towards the product sliding surface, to a second, closed end position, in which they are brought together above the lift loading table in such a way that they gradually take the products from it, supporting them on the sliding surface and simultaneously winding the opposite edges of the sheet until the edges overlap underneath the products. The machine also comprises two pairs of vertical-plane folders which are parallel with one another and with the forming line, located on either side of the products at a distance corresponding to the depth of the pack, and are mobile opposite one another alternately between two end positions. In a first, non-operating, end position, the vertical-plane folders are outside the width dimension of the pack; in the second, operating, end position, they are, in contrast, brought together. During the movement necessary to reach the second, operating position, the vertical-plane folders intercept vertical edges of the sheet, fold them about vertical fold lines and form pairs of first, vertical flaps, which are pressed against the products, then form pairs of second, horizontal flaps located on either side of the vertical-plane folders. The second station comprises two pairs of fixed folders, located on either side of the forming line and at a vertical distance from one another which depends on the height of the pack of products, and a horizontal distance from one another which depends on the depth and length of the pack. The fixed folders have helical surfaces which extend longitudinally to the forming line so as to gradually fold the second flaps until they overlap the sheet of wrapping material, positioning them against the products. First sealing means are envisaged, for sealing the edges of the sheet of wrapping material which overlap underneath the pack; second sealing means are envisaged in the third station, for sealing the first and second flaps onto the sheet of wrapping material.

In the above-mentioned packaging machines, products are packaged in packs of various sizes, which make it possible to include different numbers of rolls in the packs, with various geometrical patterns. It is possible to make individual packs containing a single roll, and multi-roll packs containing two or more rolls. In the latter type of pack, the rolls may be arranged side-by-side to form a pack containing a single layer of products, or may be arranged to allow the packaging of packs with two or more layers of rolls placed on top of one another.

A disadvantage common to all types of known machines is the fact that, in order to set up the machine for packaging a pack size other than that currently in production, numerous adjustments are required, in particular, effected using several position references which are generally different, are separately controlled by the various physical machine parts and so require separate adjustments to be effected when passing from one type of pack to another. More specifically, adjustments to the operating stations are effected relative to the product sliding surface; in contrast, adjustments to the mobile lift table refer to the lowest level of the mobile table, said level being below the product sliding surface.

This means that the machine adjustment devices are of complex construction and require lengthy, complex machine adjustment and timing operations which also disadvantageously involve physical intervention on numerous devices, located in various zones of the machine.

The aim of the present invention is, therefore, to overcome the above-mentioned disadvantages by means of a machine which is able to allow the passage from one operating set-up to another, in terms of adjustment of both the pack size and configuration, with fewer adjustments than are needed on known machines, said adjustments also being more rapid and effected automatically in a centralized fashion, enabling the machine as a whole to meet rapidly changing market requirements for different types of packaging.

A further aim of the present invention is to obtain a machine with moving parts whose movements are more limited, the advantages of this being a reduction in the times required for the operating cycles and a reduction in the dynamic stresses.

SUMMARY OF THE INVENTION

In accordance with the present invention, said aims are achieved by an automatic machine comprising adjustment means at least for the wrapper forming line, connected to centralized machine control means and designed to reference the machine adjustments required for changing the pack size to the product sliding surface.

BRIEF DESCRIPTION OF THE DRAWINGS

The technical characteristics of the invention, in accordance with the aims, are clearly described in the claims herein and the advantages are apparent from the detailed description which follows, with reference to the accompanying drawings, which illustrate a preferred embodiment of the invention, without limiting the scope of application, and in which:

DESCRIPTION OF THE PREFERRED EMBODIMENTS

Figure 2:
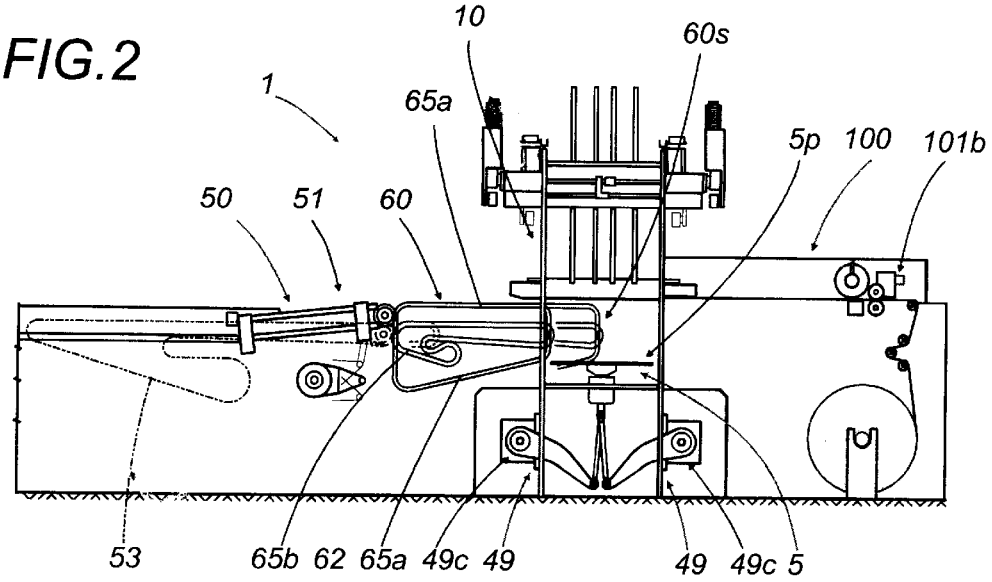
FIG. 2 is an elevation assembly view of the machine illustrated in FIG. 1.
Figure 1:
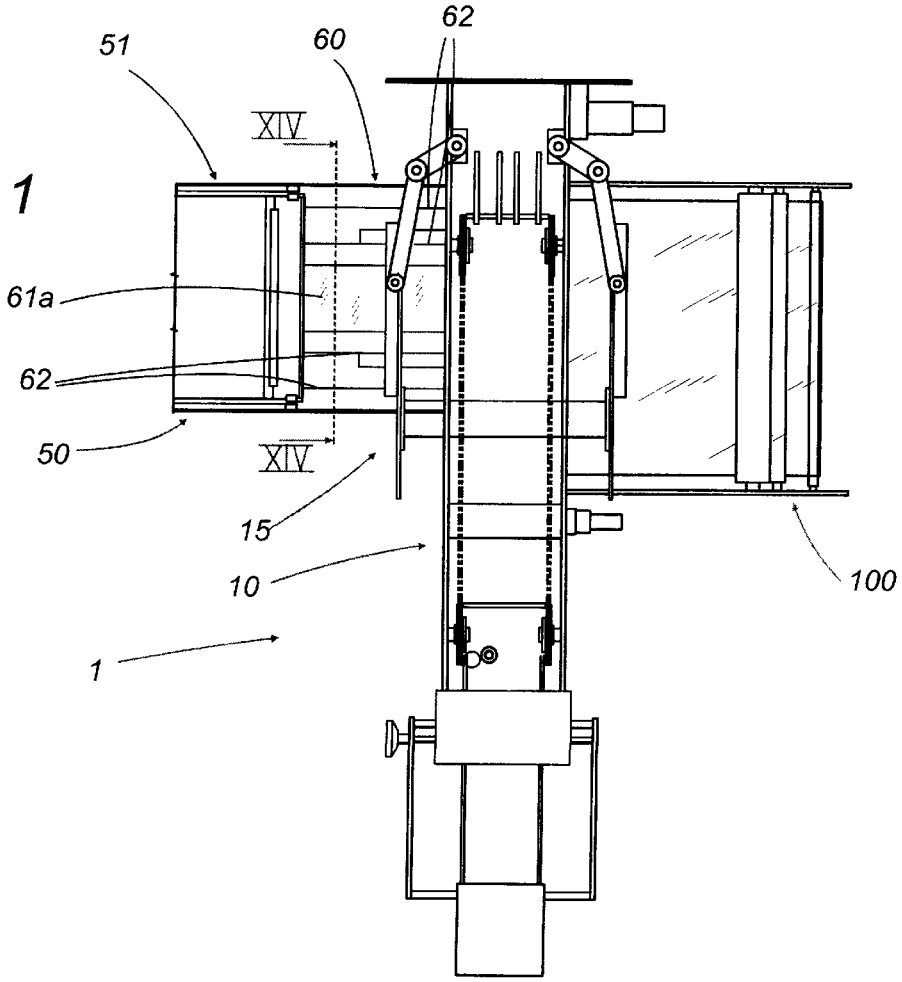
FIG. 1 is an assembly plan view of a packaging machine according to the present invention, equipped with a product feed line and a wrapping material sheet feed line.
Figure 3:
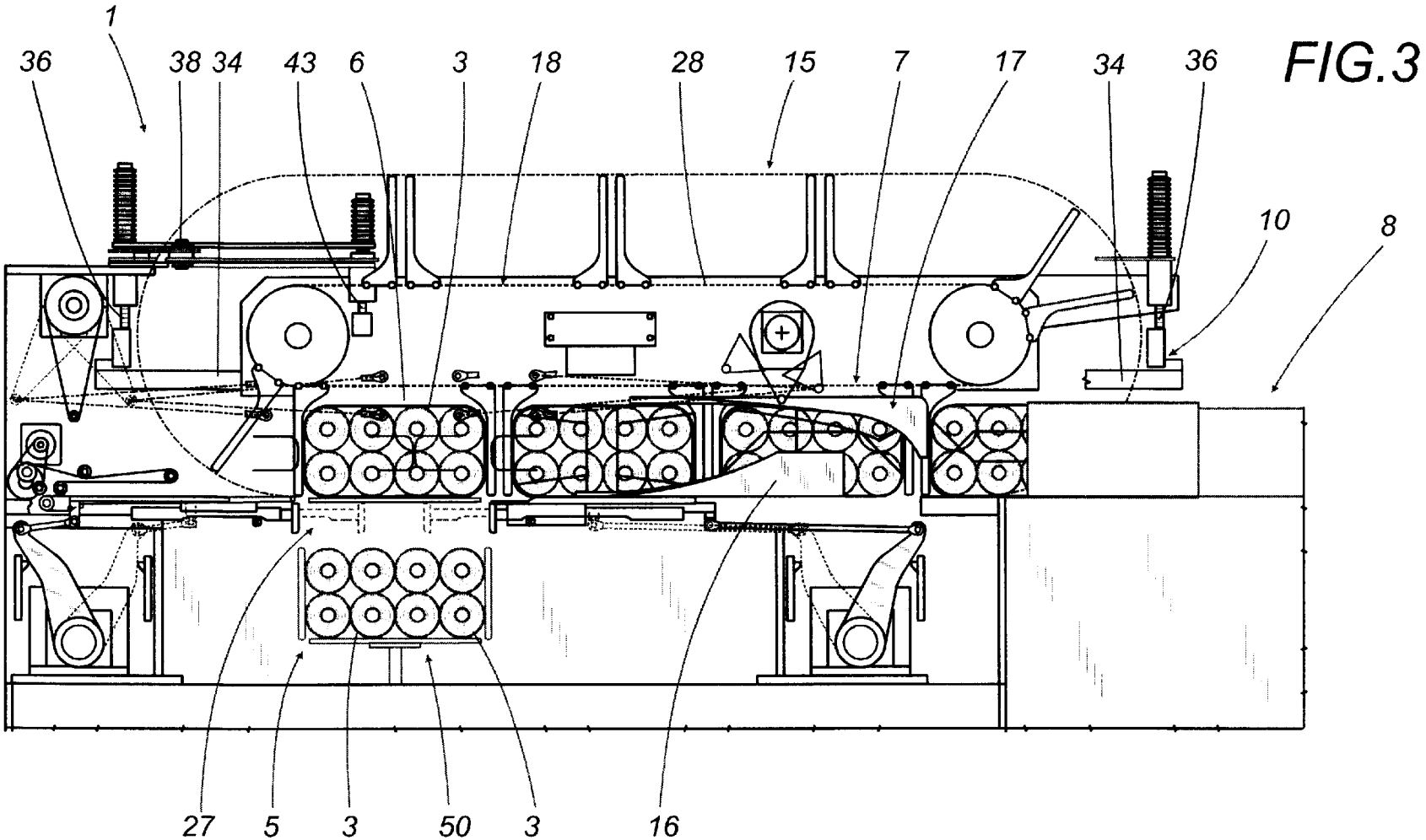
FIG. 3 is an elevation view of the machine, seen from the product feed line side.

With reference to FIGS. 1, 2, 3 in the accompanying drawings, the numeral 1 indicates as a whole an automatic packaging machine for packaging products 3 in packs 2. The products 3 consist, in particular (see FIG. 4), of rolls of paper which are held together by a wrapper 4 consisting of a sheet of plastic (polypropylene or polyethylene) which is wound around the products 3, then folded and sealed to create a complete pack of the type illustrated, without limiting the scope of application, in FIG. 4.

Figures 4, 5E:
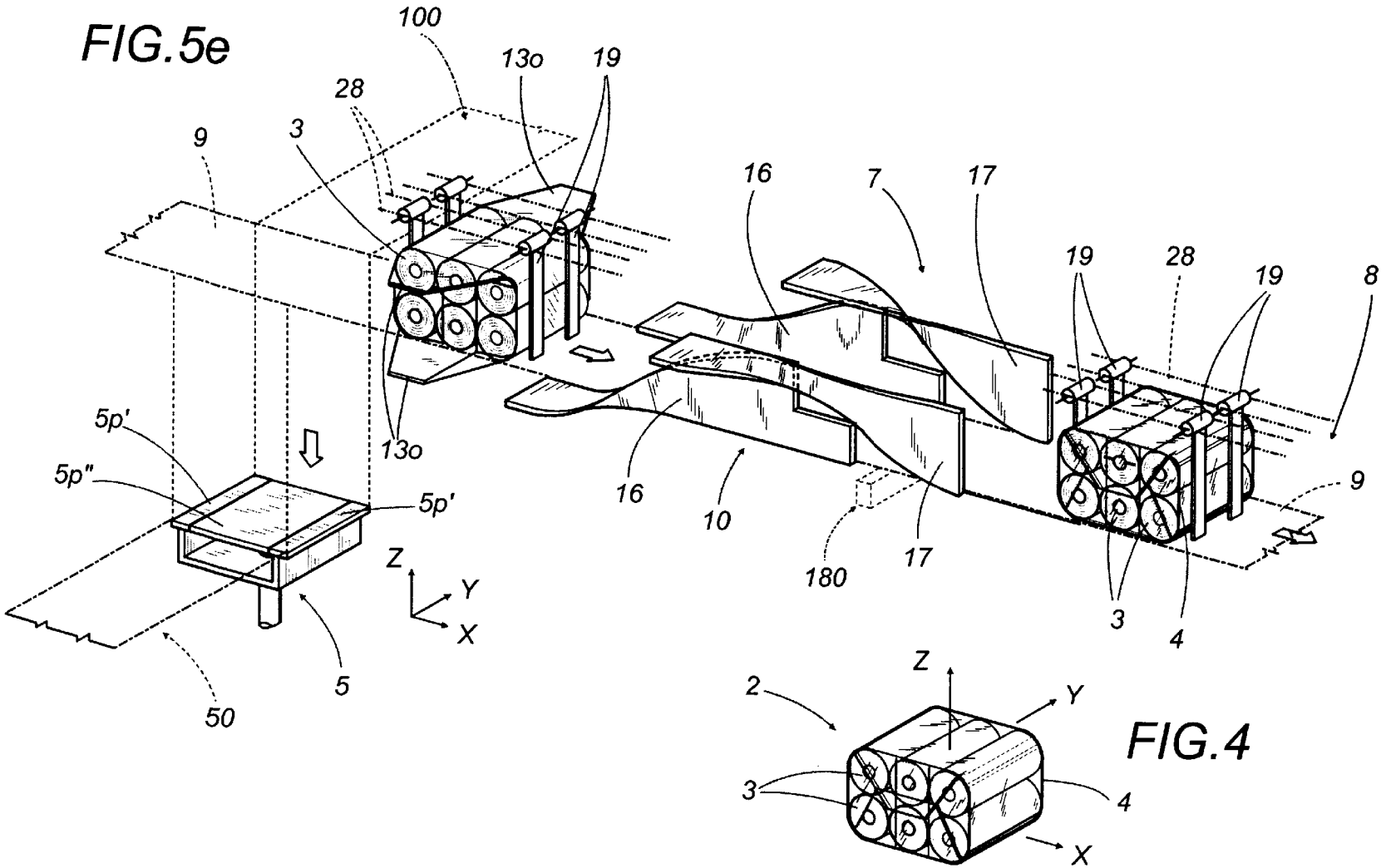
FIG. 4 is a perspective assembly view illustrating an example of a pack which can be obtained using the machine disclosed.
FIGS. 5*a*, 5*b*, 5*c*, 5*d*, 5*e* are schematic three-dimensional illustrations of the machine operating stages.

The packaging machine 1 basically comprises (see FIGS. 1 and 2) a feed line 50 for the products 3 to be packaged, a feed line 100 for the sheet of wrapping material, and a forming line 10 for the wrapper 4 for the products 3, said lines being positioned at different heights (see also FIG. 5*e*). The packaging machine 1 also comprises a lift 5 for the products to be packaged, positioned so that it operates between the product feed line 50 and the wrapper forming line 10.

The wrapper forming line 10 comprises a substantially parallelepiped-shaped machine casing 15, positioned with its long side horizontal (see FIG. 3), one end of which is located over the lift 5, there being a hopper 27 between them. The machine casing 15 houses a closed-loop transfer device 18 (see also FIG. 6*a*) equipped with consecutive pusher elements 19, alternately mounted on parallel chains 28 closed in a loop around four motor-driven toothed pulleys 28*p*. The pushers 19 are designed to push the products 3 housed between pairs of consecutive pushers 19 with intermittent, unidirectional, horizontal movement along the wrapper 4 forming line 10. The wrapper 4 forming line 10 comprises, in particular, three operating stations 6, 7, 8 positioned one after another near the base of the machine casing 15 and above a horizontal sliding surface 9 on which the products 3, held against it, move from one operating station 6, 7, 8 to the other, with stepping motion, pushed by the pusher elements 19 of the closed-loop transfer device 18.

More specifically (see FIGS. 6*a*, 6*b*), the first operating station 6 is located inside the machine casing 15, on the vertical axis of the lift 5; the station has a horizontal-plane folder 11 and counter-folder 12, both of which are mobile and are positioned below and adjacent to the product 3 sliding surface 9. The station also comprises two pairs of vertical-plane folders 13, 14 which are mobile, parallel with one another and angled longitudinally to the forming line 10.

Figure 7A:
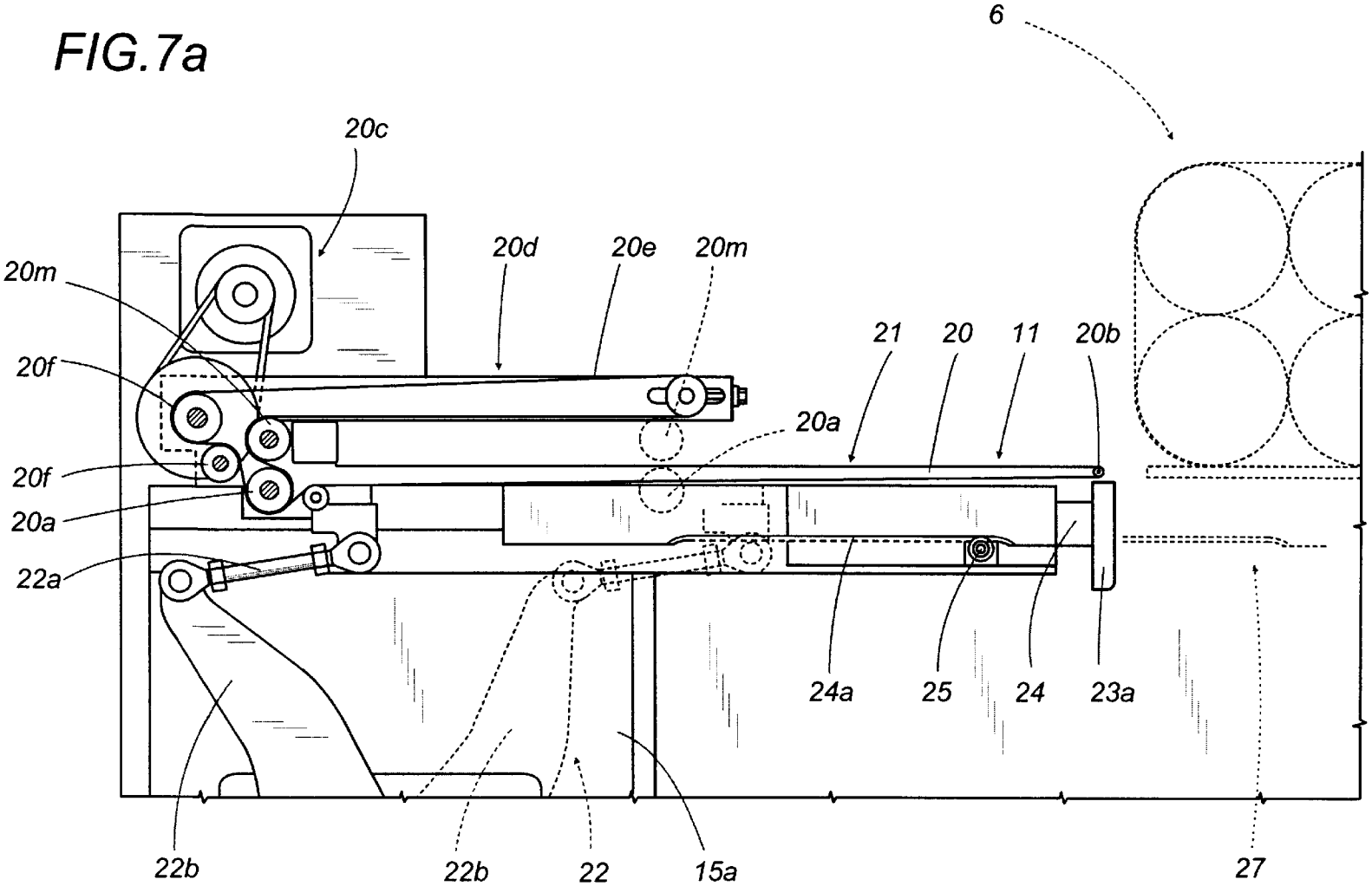
FIGS. 7*a*, 7*b* are scaled-up illustrations, with some parts cut away to better illustrate others, of some details of the machine illustrated in FIG. 3.

The horizontal-plane folder 11 (see FIG. 7*a*) is defined by a plurality of small conveyor belts 20 which are side-by-side and parallel with one another, supported in such a way that they are offset by a support structure 21, the latter guided horizontally on a fixed structure 15*a* of the machine 1. The conveyor belt 20 support structure 21 translates alternately to the fixed structure 15*a* of the machine 1 when its actuator means are activated, said means preferably consisting of a linkage 22 comprising a connecting rod 22*a*, one end of which is connected by a ball joint to the folder 11 support structure 21, whilst the other end is connected by a ball joint to a crankshaft 22*b*, in turn driven by a motor 23, preferably electronic and of the brushless type.

The conveyor belts 20 have belts closed in a loop around relative pairs of pulleys 20*a*, 20*b*, one pulley in each pair being motor-driven, so as to form an elongated horizontal loop. The motor-driven pulleys 20*a* of each belt 20 are rotated in one direction only by shared drive means 20*c*, by a mechanical transmission 20*d* with a looped belt 20*e*. The mechanical transmission 20*d* envisages winding of the looped belt 20*e* around a set of idle pulleys 20*f*, 20*m*. One of the idle pulleys (20*m*- dandy roller) can be translated by activating corresponding drive means, controlled by the machine 1 general control means, allowing the mechanical transmission 20*d* with the belt 20*e* to vary its geometric configuration in order to follow the overall translation of the folder 11, horizontally in both directions, constantly adjusting to the position reached by the latter by means of variations in the length of the sections of belt 20*e* positioned between the fixed pulleys 20*f* and the mobile idle pulley 20*m*.

Underneath the first operating station 6, and below the horizontal-plane folder 11, the machine 1 supports a first vertical wall 23*a* of the hopper 27; the wall 23*a* is supported by a horizontal rod 24 offset from the fixed structure 15*a* of the machine 1 and guided by the latter in such a way that it slides. The rod 24 has teeth 24*a* which engage with a motor-driven sprocket 25. The rotation of the sprocket 25, suitably controlled by the machine 1 centralized, main control means, allows horizontal adjustment of the position of the first wall 23*a* of the hopper, aligning it with the first operating station 6 of the machine 1 above.

The horizontal-plane counter-folder 12 (see FIG. 7*b*) consists of a surface with a tapered end 12*b*, offset from its support structure 24*b*. The support structure 24*b* is supported and guided horizontally by a fixed structure 15*b* of the machine 1 which is opposite the support structure 15*a* of the folder 11. The support structure 24*b* of the counter-folder 12 can translate alternately, horizontally, relative to the fixed structure 15*b*, upon activation of its actuator means, the latter preferably consisting of a linkage 25 (see FIG. 6*a*), comprising a connecting rod 25*a*, one end of which is connected by a ball joint to the counter-folder 12 support structure 24*b*, whilst the other end is connected by a ball joint to a crankshaft 25*b* in turn driven by a brushless electronic motor 26, controlled by the machine 1 general control means.

The counter-folder 12 and folder 11 may be connected to one another (as is more clearly described below), combining to define a horizontal surface 9 when the counter-folder 12 and folder 11 project as far as possible from the respective structures 15*a*, 15*b*. In this condition, the respective ends 12*a*, 20*b* (as indicated in FIG. 5*d*) overlap and provide the machine 1 first operating station 6 with a portion of a product sliding surface 9 which can be opened and closed horizontally with suitably timed movements of the linkages 22, 25 which drive the counter-folder 12 and folder 11, and when the relevant command is issued by the machine 1 centralized, main control means. The timing assigned to the linkages 22, 25 which drive the counter-folder 12 and folder 11 preferably envisages that when the counter-folder 12 and folder 11 are in the above-mentioned maximum projection condition, they simultaneously reach an end of stroke point positioned relative to a vertical center line 6*a* of the first operating station 6 downstream, along the wrapper 4 forming line 10, by a given distance, labeled D1 in FIG. 5*d*, where distance D1 is preferably around 70 mm.

Figure 6A:
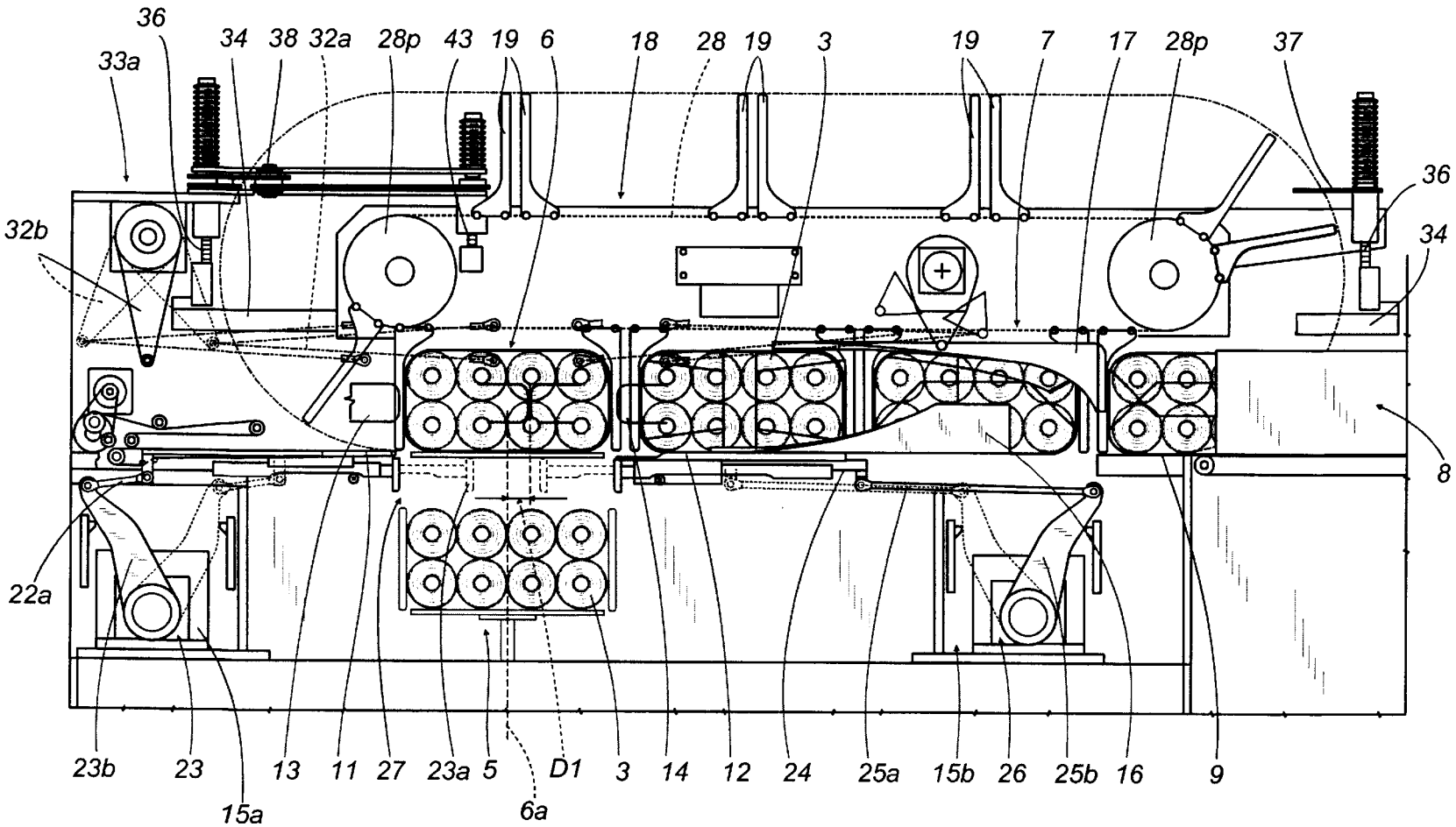
FIGS. 6*a* and 6*b* are scaled-up illustrations of some details of the machine illustrated in FIG. 3.
Figure 6B:
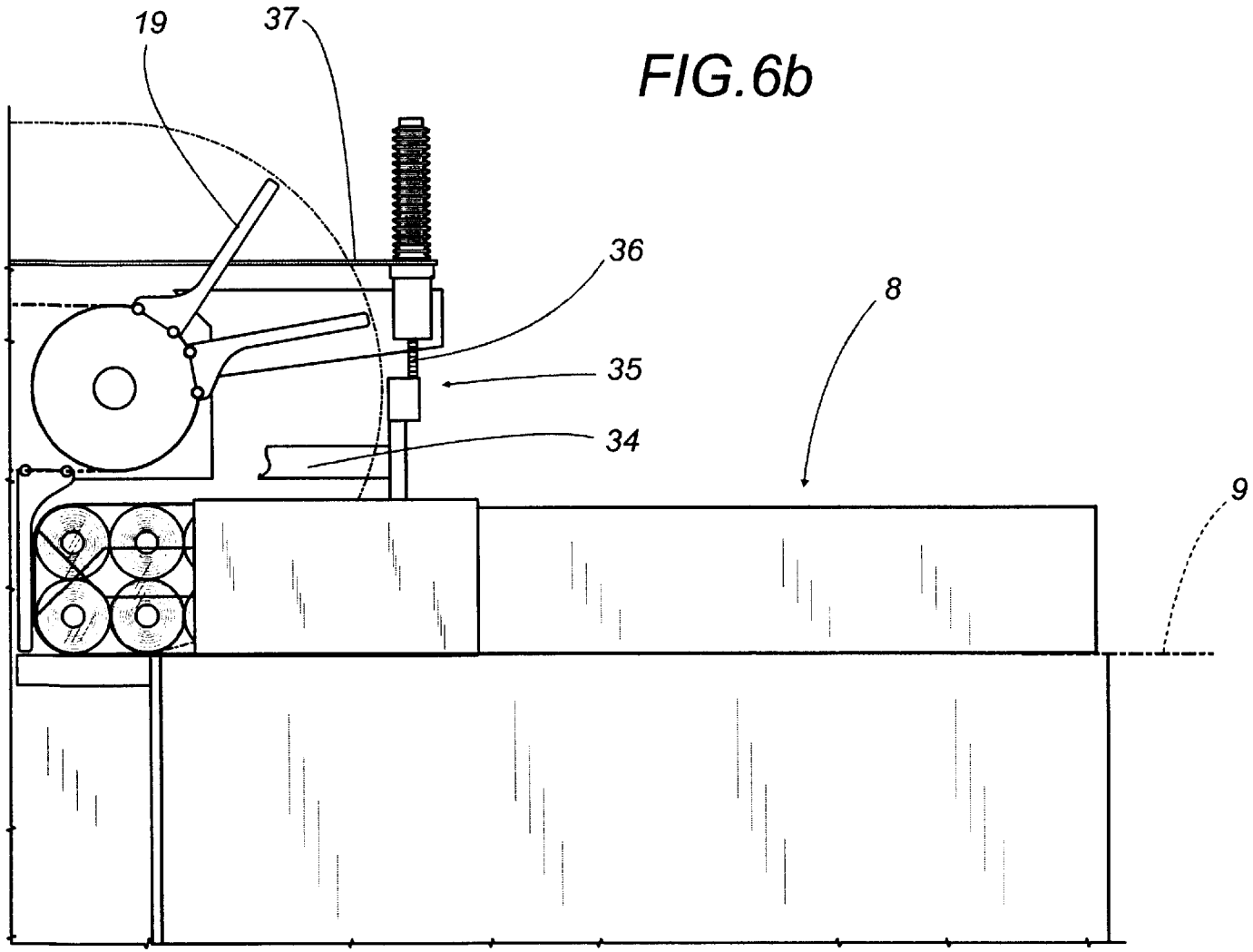

In FIG. 6*a* it can be seen that the configuration which envisages the offset support of the counter-folder 12 and folder 11 allows a machine 1 to be obtained which, as a whole, has the advantage of easy access to the zones immediately below and at the side of the first operating station 6.

The vertical-plane folders 13 and 14 consist of four flexible, vertical plates, supported in pairs parallel with one another in succession along the forming line 10 (see FIG. 6*a*). The folders 13, 14 are supported by respective supports 29 mounted in such a way that they slide in guides 31 on two parallel, vertical structural side frames 30 (see FIG. 8*c*) of the machine casing 15 (only one of the side frames 30 is illustrated in FIG. 8*c*). Four linkages 32, comprising a connecting rod 32*a* and a crankshaft 32*b*, connected to one another by ball joints (see FIGS. 6*a*, 8*b*), connect the supports 29 of the opposite vertical-plane folders 13, 14 of the two side frames 30 to respective motors 33*a*, 33*b* shared by each pair of folders 13, 14. The motors 33*a*, 33*b* are preferably of the brushless electronic type. The machine casing 15, therefore, houses two motors 33*a* and 33*b*, controlled by the machine 1 general control means which, by means of the linkages 32, cause the four folder plates 13, 14 to translate horizontally and alternately, in pairs and in opposite directions, along the forming line 10. The two pairs of vertical-plane folders 13, 14 are moved between two end positions in which they are respectively furthest apart and closest together. Again, the timing of the linkages 32 is such that the pairs of vertical-plane folders 13, 14 reach the position in which they are closest to one another at a point that is translated along the wrapper 4 forming line 10, being distance D1 downstream of the vertical center line 6*a* of the first operating station 6 (see FIG. 6*a*).

The connecting rods 32*a* and crankshafts 32*b* of the linkages 32 are connected by ball joints and their angle to one another may be adjusted so as to adjust the relative position of the folders 13, 14 according to the horizontal dimension of the pack positioned longitudinally to the forming line 10 (pack length detected along the direction of the reference axis X in FIG. 4).

The corresponding folders 13, 14 of the two side frames 30 also have adjustment means, which allow the folders 13, 14 to be opened horizontally, transversal to the forming line 10 (along the reference axis Y in FIG. 4), and translated vertically (along the reference axis Z in FIG. 4), so that they can be adjusted according to the variations in the other dimensions (depth and height) of the pack 2, which correspond with the various sizes of the packs of products 3 that can be obtained using the machine 1.

The fact that, as indicated above, both pairs of vertical-plane folders 13, 14 are mobile along the forming line 10 is a characteristic which, allowing the vertical-plane folders 13, 14 to make smaller movements, allows a reduction in the dynamic effects and means that, all other conditions being equal, the machine 1 operates at a higher speed.

Figure 7B:
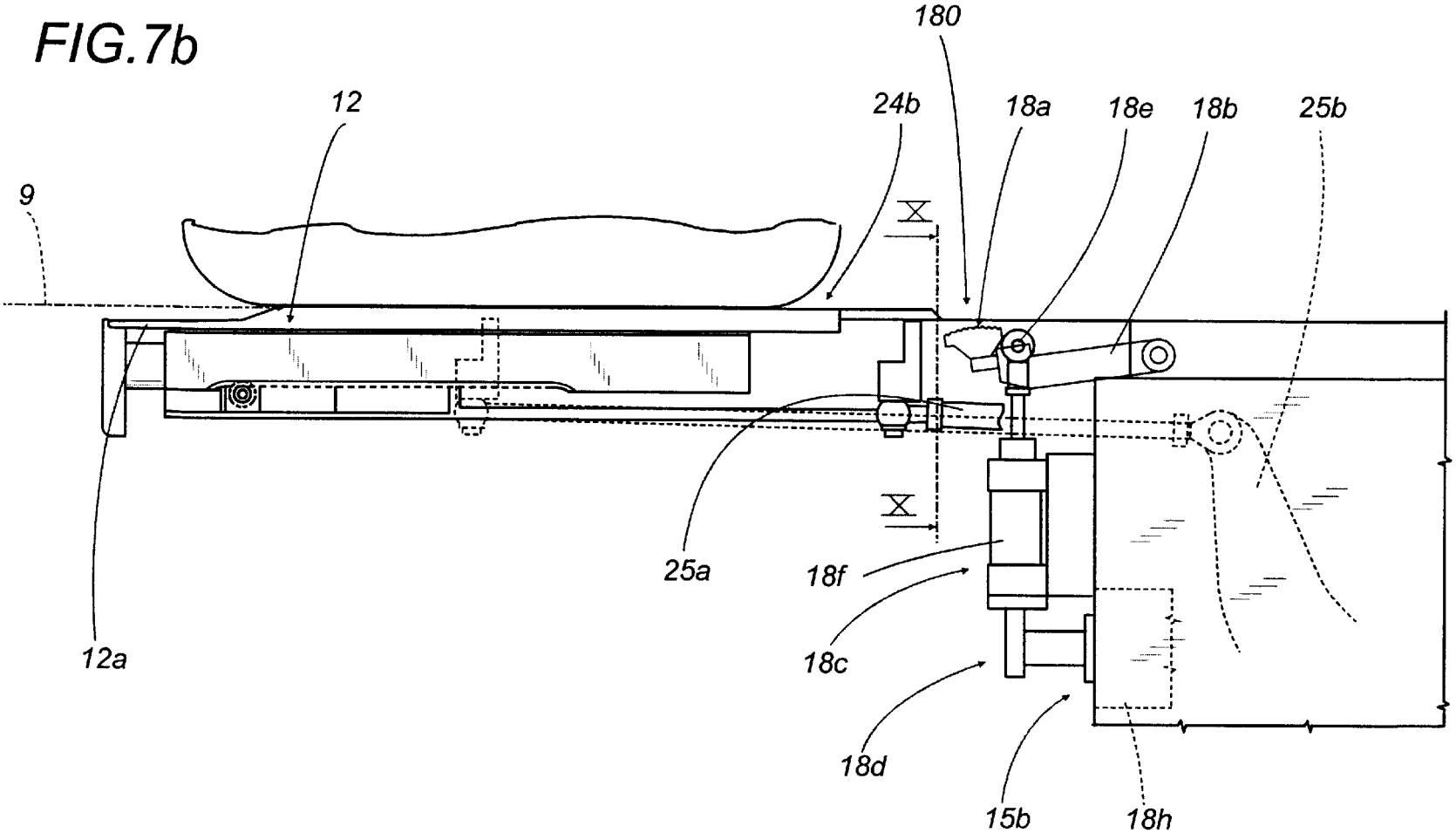

The second operating station 7 comprises two pairs of fixed folders 16, 17, positioned one after another inside the machine casing 15, and first sealing means 180 located between the two pairs of folders 16, 17 (see FIGS. 6*a*, 7*b*).

The fixed folders 16 of the first pair (see FIGS. 3 and 6*a*) are located on either side of the forming line 10 and have helical surfaces which extend longitudinally to the forming line 10. The fixed folders 17 of the second pair are also positioned on either side of the forming line 10, have helical surfaces extending longitudinally to the forming line 10 and are further forward and higher than the first pair relative to the product sliding surface 9.

The lower fixed folders 16 can be opened horizontally, transversal to the forming line 10. The upper fixed folders 17, as well as opening horizontally, may also be adjusted vertically, to adjust them to variations in the height of the pack.

The machine 1 also comprises (see FIGS. 3–6*a*–6*b*) horizontal beams 34 inside the machine casing 15, positioned longitudinally to the forming line 10 at the sides of the pusher elements 19 of the closed-loop transfer device 18. The horizontal beams 34 pass through the entire length of the machine casing 15 and, being above the first and second operating stations 6, 7 and at least part of the third operating station 8, combine to form top horizontal contact surfaces envisaged to contrast the tops of the packs 2 of products in transit along the wrapper 4 forming line 10.

The beams 34 are supported at each end by supports 35 (see FIG. 6*b*) which have lead screws engaged on four vertical, motor-driven worm screws 36. The worm screws 36 are connected together by a shared drive chain 37, on a horizontal plane and connected to a driving sprocket 38 which is, in turn, driven by a brushless electronic motor (see FIG. 9). Activation of the sprocket 38 of this motor, controlled by the machine centralized, main control means, allows the top horizontal contact surface defined by the beams 34 to be raised and lowered relative to the product sliding surface 9 below.

Figure 9:
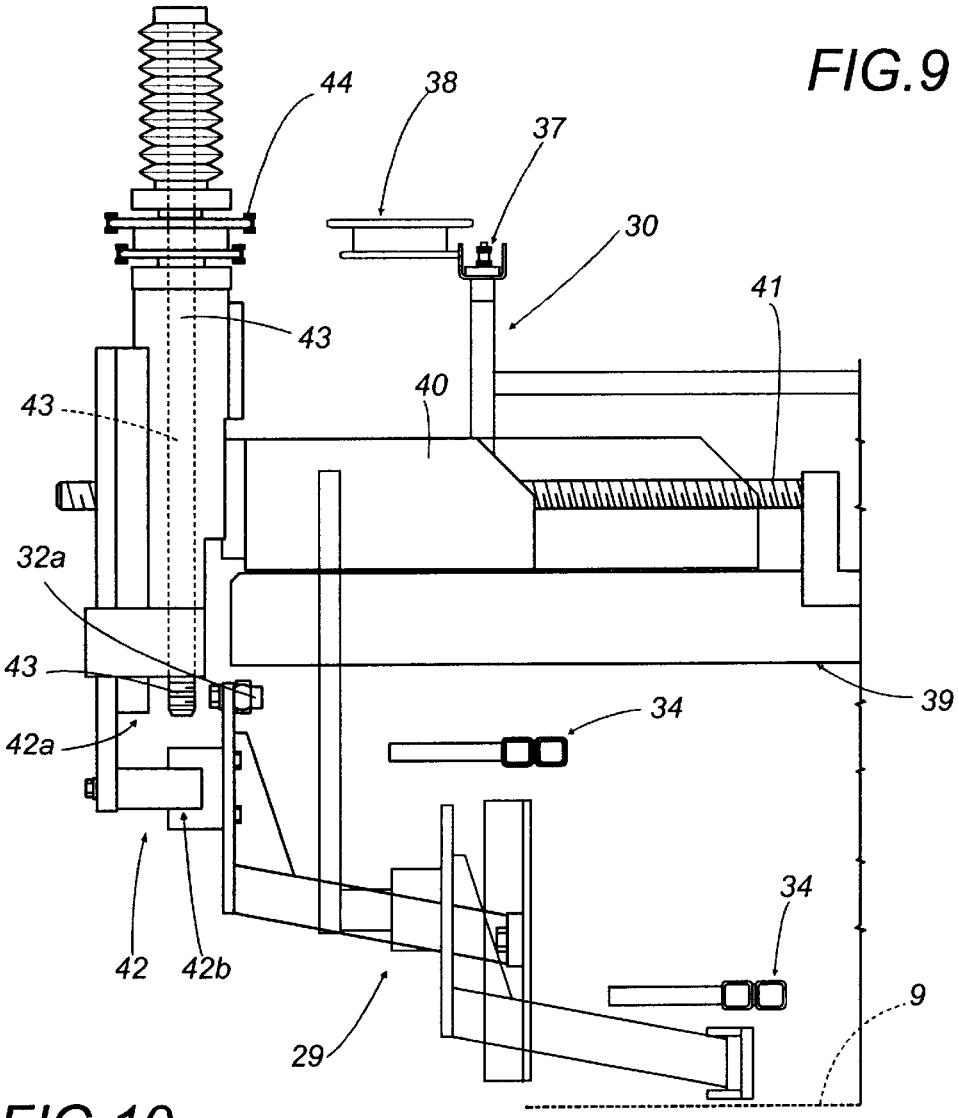
FIG. 9 is a scaled-up partial view of the machine illustrated in FIG. 3, cross-sectioned vertically.

Moreover, FIG. 9 also shows that the tops of the side frames 30 of the machine casing 15 are connected to one another by fixed horizontal beams 39 which support in guides two first horizontally sliding carriages 40 (the Figure illustrates only half of the machine 1, but the description herein applies symmetrically to the other half of the machine 1). The first carriages 40 translate relative to the beams 39 by means of a motor-driven worm screw 41 (powered by a brushless electronic motor controlled by the machine 1 centralized, main control means) on which the first carriages 40 engage. The worm screw 41 has opposite threads at the two opposite side frames 30 of the machine casing 15, so that the same rotation of the worm screws 41 causes simultaneous translation of the two first carriages 40 engaged on said screw 41, the carriages translating horizontally opposite one another, moving away from or towards each another, depending on the direction of rotation of the worm screw 41. Second carriages 42 are supported by each first carriage 40 in such a way that they slide in guides in a vertical direction and support the vertical-plane folders 13 and 14 by means of a horizontal guide 42*b* along which the vertical-plane folders 13 and 14 translate under the action of the respective connecting rods 32*a*. The translation of the second carriages 42 is driven by a vertical worm screw 43 which, depending on the direction of rotation, raises or lowers its second carriage 42 vertically, at the same time varying the height of the vertical-plane folders 13 and 14 relative to the product sliding surface 9 along the machine 1 forming line 10.

Figure 8A:
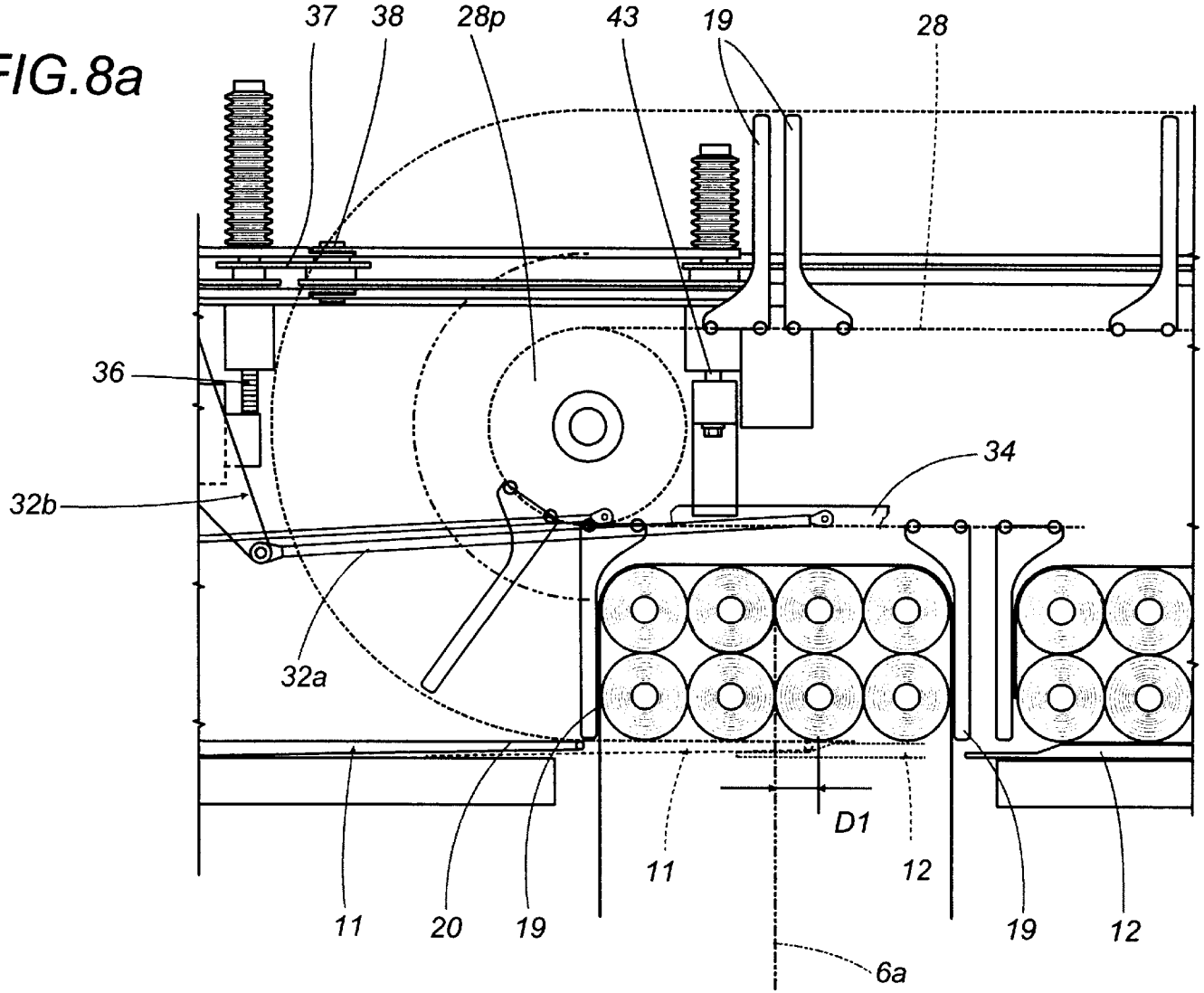
FIGS. 8*a*, 8*b*, 8*c* are scaled-up details, respectively in an elevation view, a top plan view and a side view, with some parts cut away to better illustrate others, of some details of the machine illustrated in FIG. 3.
Figure 8B:
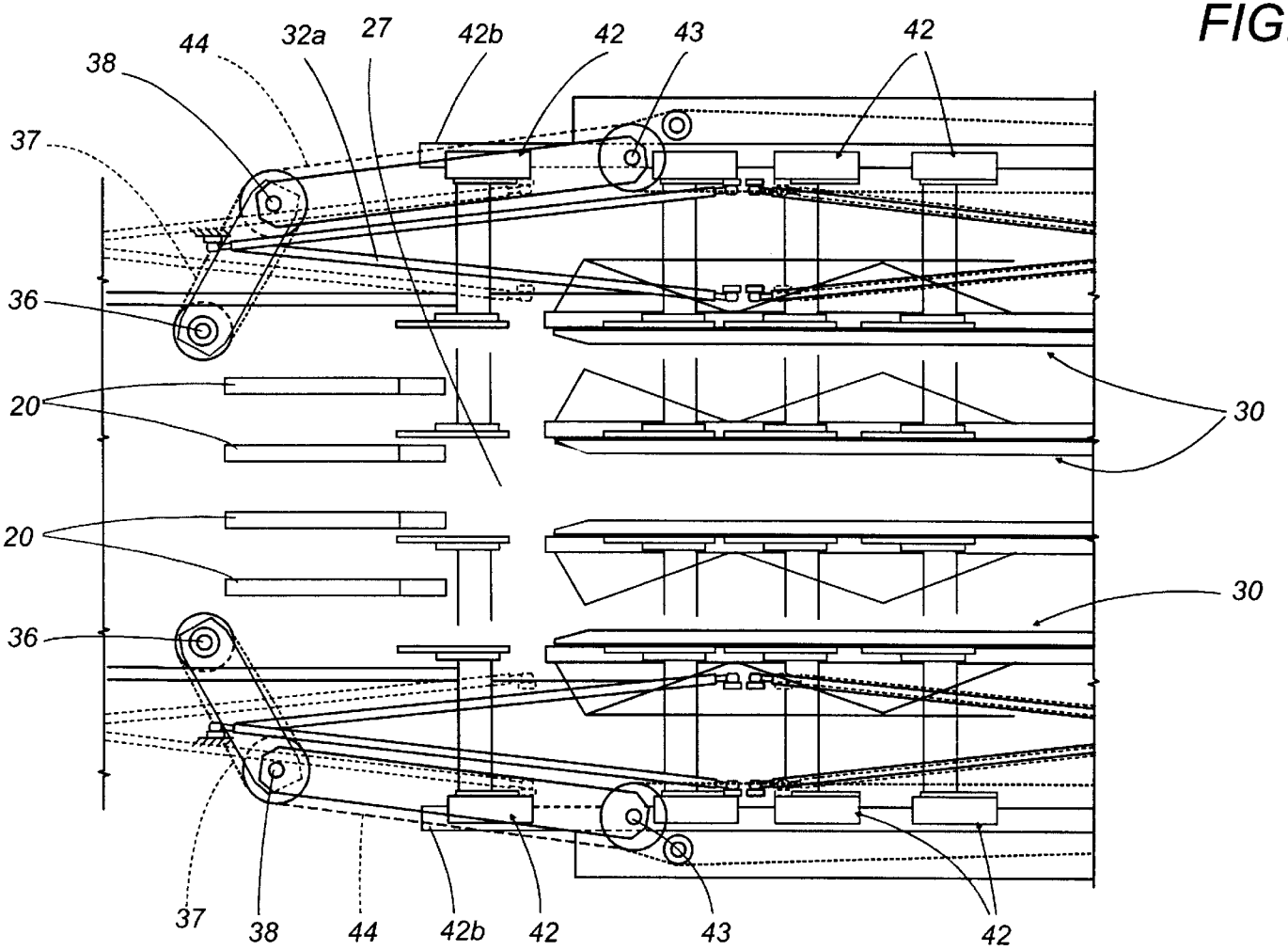
Figure 8C:
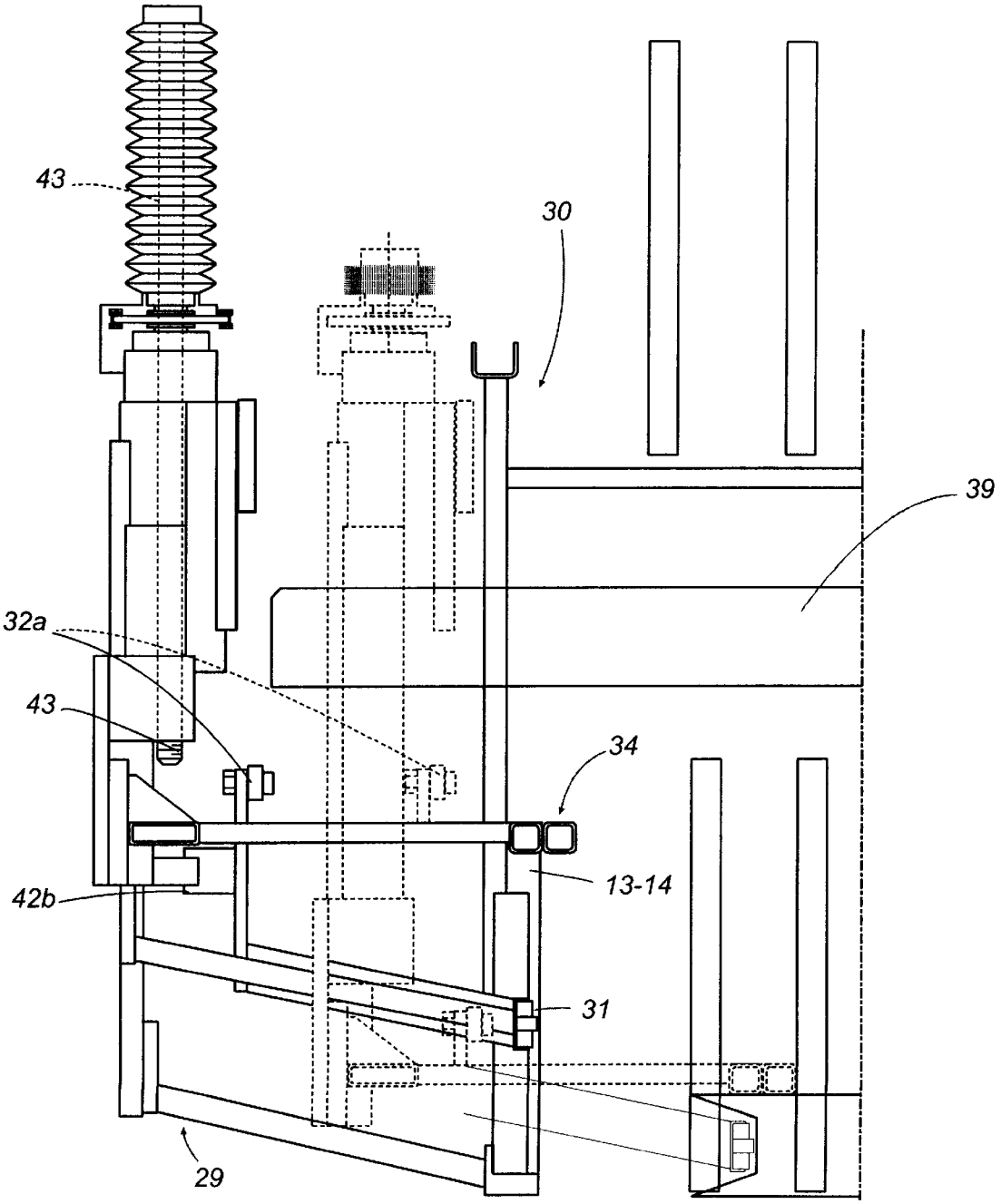

From FIGS. 8*a*, 8*b* and 9 it can be seen that the sprocket 38 drives not only the chain 37 which drives the worm screws 36 of the top surface, but also a chain 44 which causes the vertical worm screws 43 of the second carriages 42 to rotate. However, since the stroke of the vertical translation of the vertical-plane folder elements 13, 14 must be half that of the movements of the top surface (the vertical-plane folder elements 13, 14 are positioned half way up the pack 2 of products), the worm screw 43 has half the pitch of the worm screws 36 which drive the top surface.

It is, therefore, evident that the vertical movement of the top surface constituted by the beams 34 allows the machine 1 to be set up according to variations in the height (relative to the sliding surface 9) of the packs 2 of products 3 in transit along the wrapper 4 forming line 10. This adjustment, relative to the sliding surface 9, can also be correlated with variations in the vertical distance between the pairs of fixed folders 16 and 17 of the machine 1 second operating station 7. In contrast, adjustments correlated to size variations, related to pack 2 depth (direction Y in FIG. 4) are effected when the worm screw 41 is activated, and may also be correlated with the corresponding adjustments to the width separating the fixed folders 16 and 17 of the second operating station 7.

The adjustments related to the length of the packs 2 are effected by adjusting the strokes of the linkages 22, 25, 32 which respectively drive the horizontal-plane folder 11 and counter-folder 12 and the vertical-plane folders 13, 14. Finally, variations in the distance between the pusher elements 19 of the closed-loop transfer device 18 are made by changing the relative timing of the parallel chains 28 which alternately support the consecutive pushers 19.

It should be noted that the above-mentioned adjustments are all controlled by the machine 1 centralized, main control means with reference only to the product 3 sliding surface 9.

Figure 10:
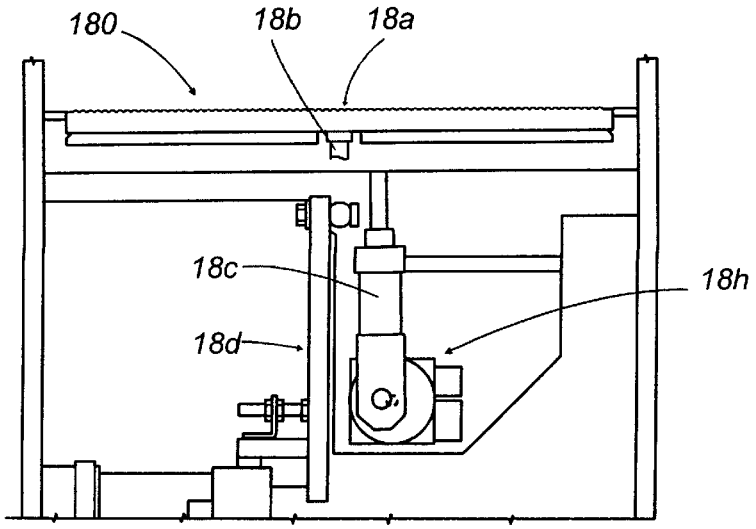
FIG. 10 is a cross section of the machine through line X—X in FIG. 7*b;*

Returning to the second operating station 7, FIGS. 6*a*, 7*b* and 10 show in more detail that the first sealing means 180 comprise a sealing bar 18*a* supported across the product 3 sliding surface 9, transversal to the wrapper 4 forming line 10. The sealing bar 18*a* is supported by a system of parallel rods 18*b*, one end of the rods being connected to the sealing bar 18*a*, whilst the other end is connected to the machine 1 structure. The rods 18*b* are all connected to one end of a connecting rod 18*c* of variable length, the other end of which is connected to a motor-driven cam 18*d*. A reduction gear driven by a brushless electronic motor 18*h* causes the cam 18*d* to rotate, allowing the sealing bar 18*a* to periodically rise from the product sliding surface 9 and be held in a raised position for a period of time sufficient to seal the sheet of wrapping material. Thanks to the use of the brushless motor, said time may be set from the program, so that the sealing is effected with invariable times, irrespective of the speed of the forming line 10. The connecting rod 18*c* of variable length is driven, specifically, by a pneumatic piston whose rod 18*e* is jointed to the sealing bar 18*a* and whose cylinder 18*f* is jointed to the cam 18*d*. The machine 1 centralized, main control means control not only activation of the motor 18*h*, but also activation of the cylinder 18*f* and, when the machine 1 stops in an emergency condition, withdraw the rod 18*e* into the cylinder 18*f*, thus lowering the sealing bar 18*a* below the sliding surface 9 (see FIG. 7*b*). This construction configuration allows the creation of safety means which prevent accidental burning of the sheet of wrapping material on the pack 2 of products 3 in the event of a fault in machine 1 operation.

Figure 11A:
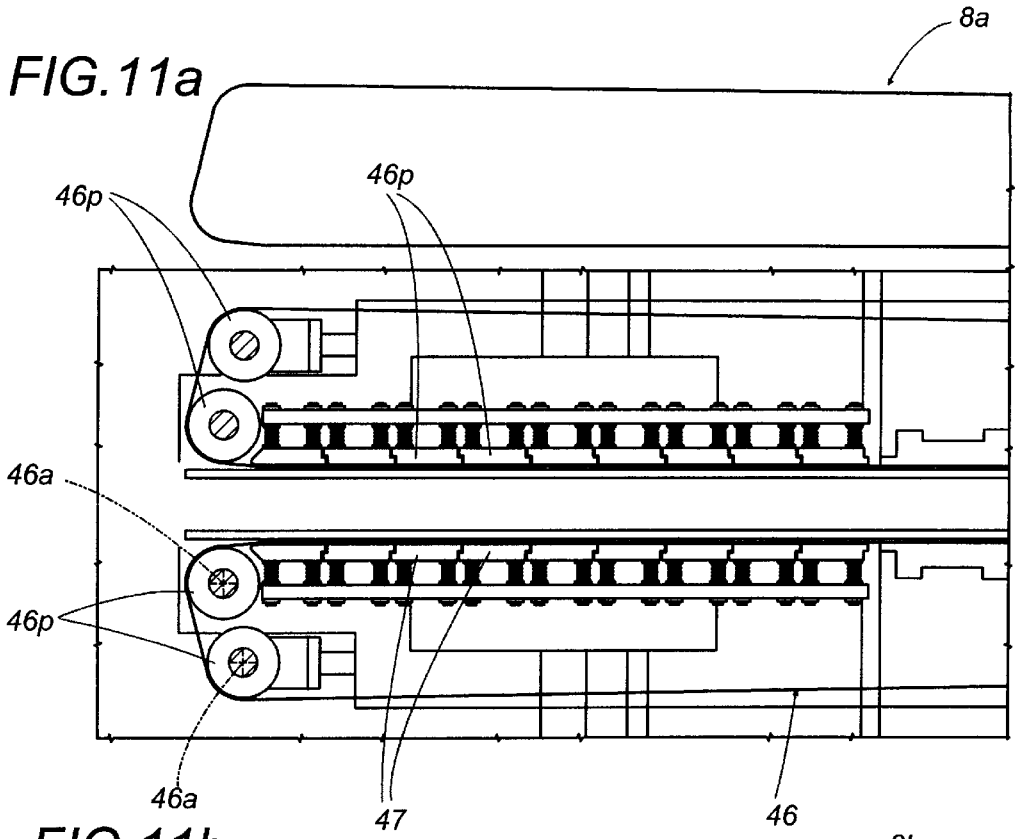
FIGS. 11*a*, 11*b* are scaled-up, partial top plan views of a detail of the machine illustrated in FIG. 3.
Figure 11B:
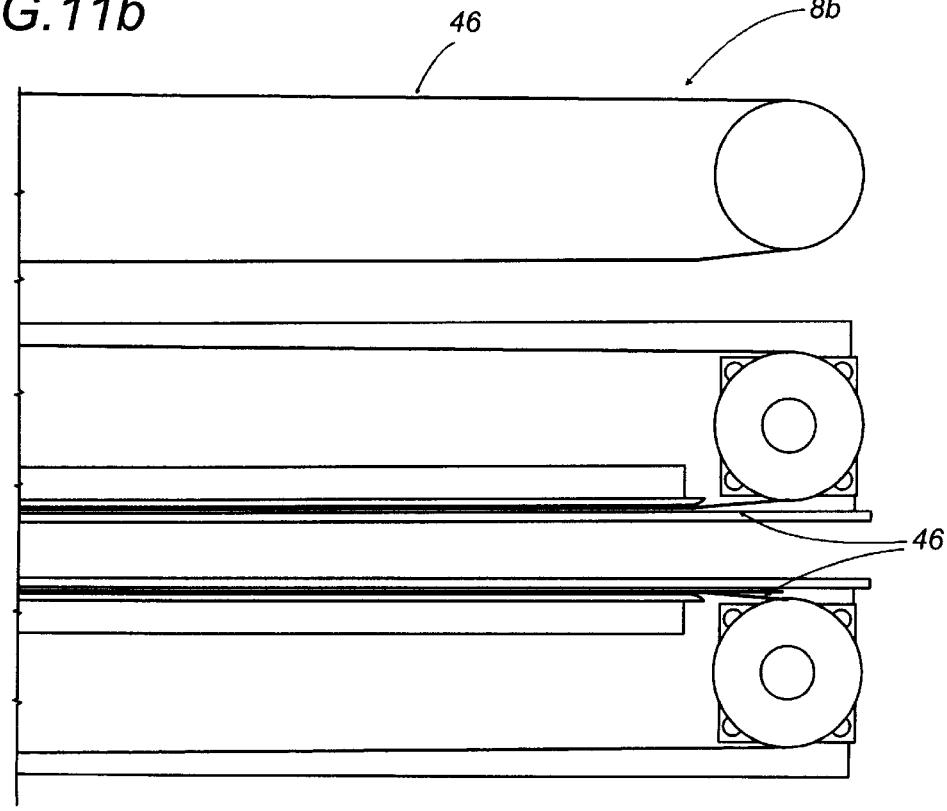

The third operating station 8, as can been seen in FIG. 3 and FIGS. 11*a*, 11*b*, is supported in such a way that it is partially offset by the machine casing 15 along the wrapper forming line 10 and is substantially divided into two consecutive sections 8*a* and 8*b*, respectively envisaged for sealing the wrapper 4 and allowing the subsequent cooling and setting of the seals.

More specifically, the third operating station 8 comprises two belts 46 (see FIGS. 11*a*, 11*b*) closed in loops around motor-driven pulleys 46*p* and rotating about vertical axes 46*a*, the belts positioned in such a way that they form opposite elongated loops along the wrapper forming line 10. At the first section 8*a* of the third operating station 8, there are sealing elements 47, fitted with heating elements, inside the looped belts 46. The sealing elements 47 are made of an antifriction material and press the looped belts 46 against the packs 2 of products between them, sealing the wrapping sheet in the conventional way.

Figure 5A:
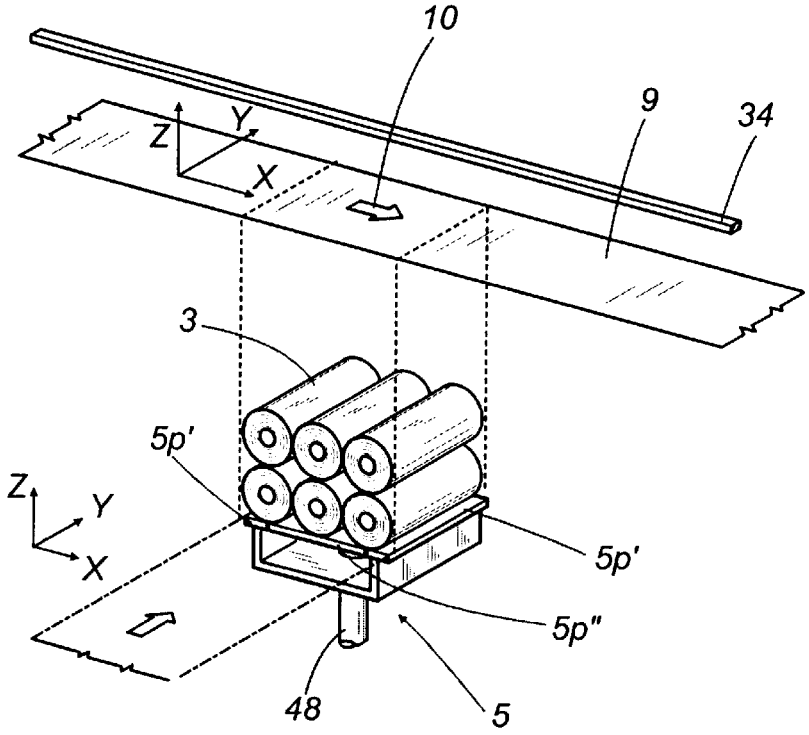
Figure 5B:
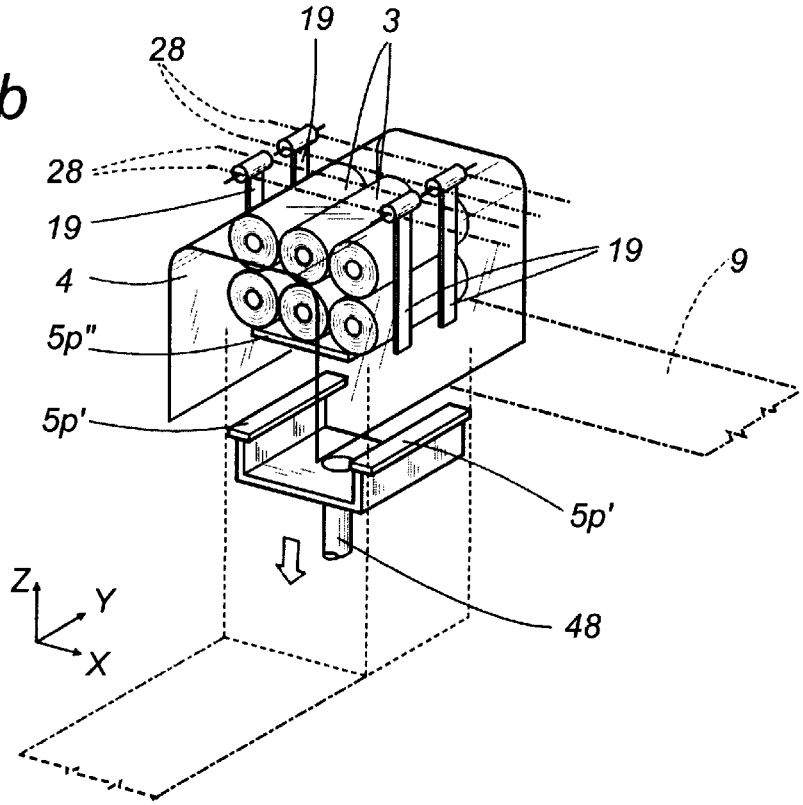
Figure 5C:
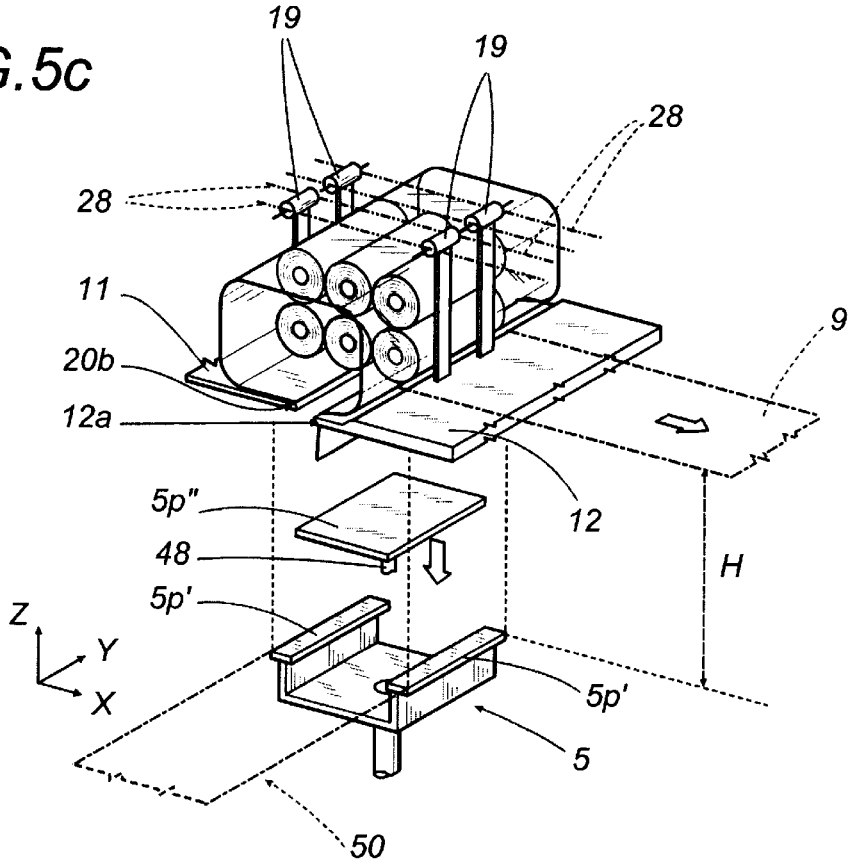
Figure 5D:
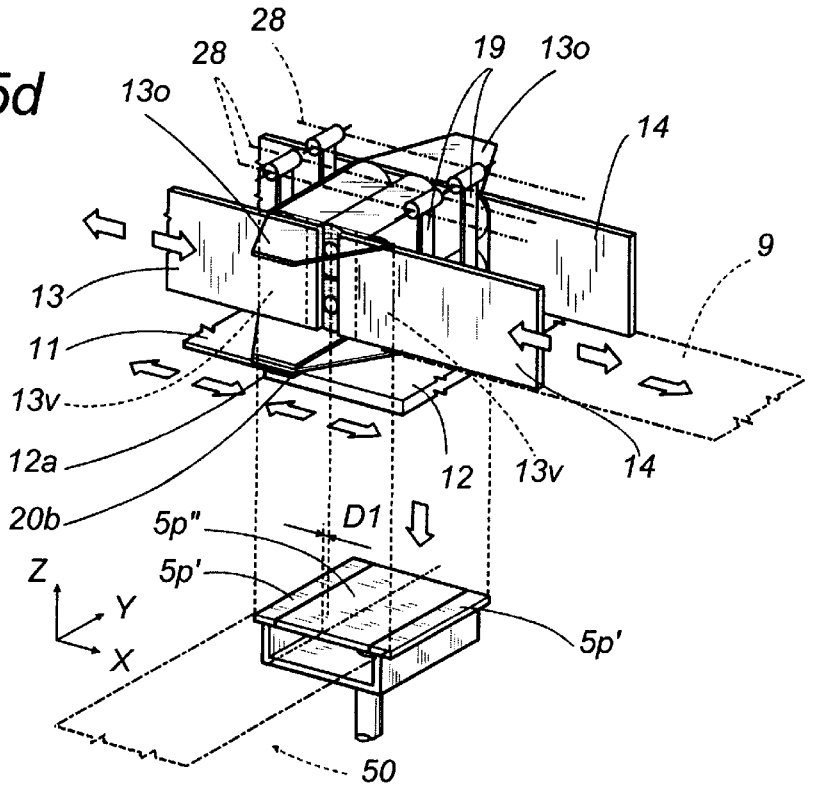

As regards the product lift 5, FIGS. 5*a* and 5*d* show in particular that it is positioned below the product sliding surface 9 and is vertically and alternately mobile between a lowered level, at which it receives the ready-stacked products 3 onto its horizontal loading table 5*p*, and a raised level, at which it places the products 3 in the first operating station 6, on the sliding surface 9, feeding them between pairs of consecutive pushers 19 on the looped transfer device 18, with a sheet of wrapping material received from the film feed line 100 laid on top of the products.

More specifically, the lift 5 loading table 5*p* is divided into three adjacent elements, the external ones 5*p*' being integral with one another, whilst the central element 5*p*" is independent of the other two elements 5*p*'.

Figure 12:
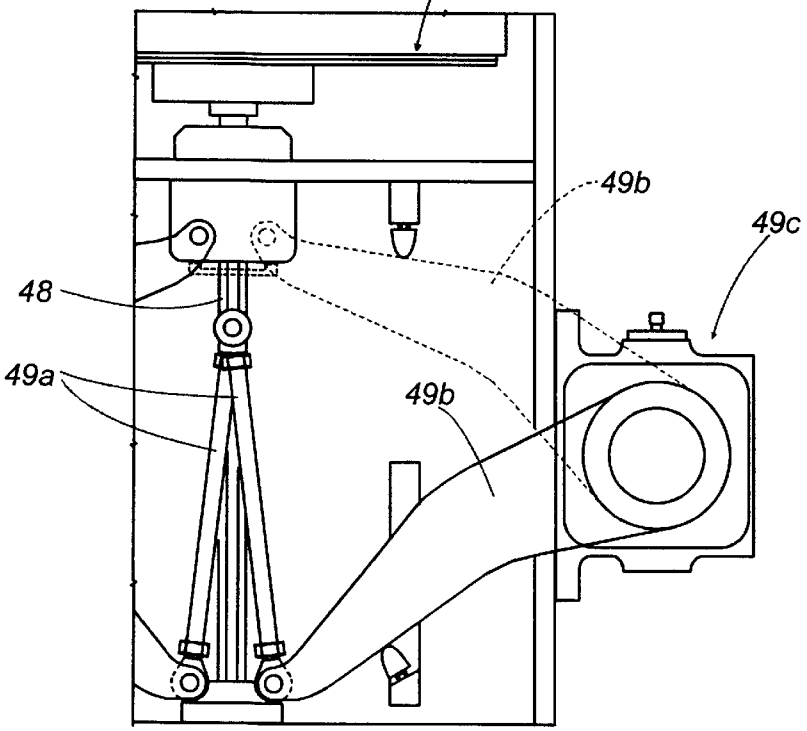
FIG. 12 is a scaled-up, partial view of a detail illustrated in FIG. 2.

Two guide rods 48 allow the vertical translation respectively of the two external elements 5*p*' and the central element 5*p*" of the loading table 5*p* when corresponding actuator means are activated. The actuator means consist, in particular (see FIG. 12), of two independent linkages 49, each of which drives one of the guide rods 48 and comprises connecting rods 49*a* jointed at one end to the guide rods 48 of the elements 5*p*', 5*p*" and connected in such a way that they can rotate to crankshafts 49*b* driven by two brushless electronic motors 49*c*, controlled by the machine 1 centralized, main control means.

The elements 5*p*' and 5*p*" of the loading table 5*p* are moved by the corresponding actuator means, with different sequences, depending on the number and arrangement of the products 3 on the loading table 5*p*. For configurations which envisage two or more rolls of products 3 side-by-side on the loading table 5*p*, the external elements 5*p*' are moved to the level of the product 3 sliding surface 9 then immediately returned to the lowered position; in contrast, after reaching the product sliding surface 9, the central element 5*p*" stops in that position and remains there for a given interval. At the end of the wait interval, the central element 5*p*" returns to the lowered level of the loading table 5*p*. For product packs which require a different sequence of movements to that described above (such as packs containing only one or two products, where no wait interval is necessary), the sequence can easily be reprogrammed by intervening exclusively via the software on the machine centralized control means, without necessitating any intervention on the physical elements 5*p*' and 5*p*" of the lift 5.

Adjustments to the lift 5 stroke correlated with variations in the size of packs 2 of products, during packaging (pack height), again refer only to the product sliding surface 9 along the forming line 10. In other words, the logic behind adjustment of the lift 5 stroke, necessary to adapt it to a different pack 2 height, envisages definition of the various positions of the loading table 5*p* in terms of lowering movements H of the loading table 5*p* relative to the product 3 sliding surface 9 along the wrapper 4 forming line 10 (see FIG. 5*c*). This characteristic is advantageous in that it allows a reduction in the overall number of machine 1 adjustments, meaning that they are also easier to control.

As regards the product feed line 50, with reference to FIGS. 1 and 2, it may be seen that it basically comprises a feeder 51 for sets of products, suitably grouped by conventional dosing means, not illustrated, which in turn feeds a transfer device 60 for the layered products, designed to feed the lift 5.

The product set feeder 51 basically comprises (see FIGS. 1, 2, 13*a*, 13*b*) a fixed support structure 51*a* which, on either side of a horizontal product 3 support surface 52, supports two parallel chains 53 wound in a loop and over a series of pulleys 54, and connected by transversal bars 55*b* to the surface 52, the bars designed to make contact with the products 3 on the surface 52 and push them from one end of the feeder 51 to the other when the chains 53 run tangentially to the pulleys 54.

The feeder 51 is structured in such a way that it has an arm 55 which is mobile relative to the fixed structure 51*a*. The arm 55 supports the pulleys 54*e* of the chains 53 located near the unloading end 51*b* of the feeder 51 and is connected to the fixed structure 51*a* by a plate 56 which is hinged to the fixed structure 51*a* and housed in such a way that it can slide in a slot 57 in the arm 55. The arm 55 also has drive means, consisting of a brushless motor 58 which drives a linkage 59 connected to the arm 55, the drive means designed to make the arm 55 rotate on the fixed structure 51*a* so as to raise or lower the unloading end 51*b* of the feeder 51 relative to the product sliding surface 52. The product sliding surface 52 is shaped in such a way that it guarantees that the products are constantly supported, even as the unloading end 51*b* of the feeder 51 moves away from the fixed structure 51*a*. This movement away from the fixed structure is allowed by the sliding of the slot 57 on the plate 56 fixed to the fixed structure 51*a*.

Tensioning means 59 for the chains 53 vary the length of the sections of the chains 53 between the various pulleys 54, allowing the chains 53 to follow the telescopic removal movement of the arm 55, maintaining the tension on the pulleys 54 substantially unchanged.

Reaction means are envisaged between the arm 55 and the fixed support structure 51*a*, said means designed to counteract the rotation of the arm 55 due to the weight of the arm 55. The reaction means comprise one or more pneumatic cylinders 380 (see FIG. 13*b*), powered by a control circuit with a pressure intensity controlled by the centralized control means, also designed to counteract the rotation of the arm 55 about the point at which it is hinged to the fixed structure 51*a*. The cylinders 380, therefore, act as a pneumatic spring which provides the following advantages: allows a reduction in the torque required of the motor 58; allows the arm 55 to be rotated, and hence repositioned, more rapidly; allows accidental dropping of the arm 55 to be avoided if the motor 58 power supply is cut, or if the safety systems fail to function efficiently.

The transfer device 60 (see FIG. 2) is positioned adjacent to the free, that is to say, unloading end 51*b* of the arm 55, between the feeder 51 and the lift 5, and its structure comprises four sides 62, consisting of two parallel pairs, supported by two looped transfer devices 64 fitted with pairs of parallel chains 65*a*, 65*b* connected by product 3 pusher bars 63, distributed along separate looped paths, of equal length but different shapes, which extend one inside the other within the transfer device 60.

Overlapping, horizontal transfer surfaces 61*a*, 61*b* alternately receive the products 3 from the unloading end 51*b* of the feeder 51. The products 3 received are then intercepted by the pusher bars 63 and gradually pushed towards the end 60*s* of the transfer device 60 next to the lift 5.

The height of the horizontal transfer surfaces 61*a*, 61*b* may be adjusted to align them with the loading table 5*p* of the lift 5, using adjustment means correlated with the height of the product sliding surface 9 inside the machine casing 15.

A horizontally mobile slide supports both the arm 55 of the feeder 51 and the transfer device 60 in such a way that the unloading end 60*s* of the transfer device 60 is above the loading table 5*p* of the lift 5, translating the arm 55 of the feeder 51 along the slot 57 without interrupting the continuity of the support surface for the products fed.

The sides 62 of the two transfer surfaces 61*a*, 61*b* are rigidly connected to the walls 27*a* of the hoppers 27 by rigid rods attached with cardan joints. The rods and cardan joints constitute more general adjustment means, controlled by the machine 1 centralized control means to impart a simultaneous automatic adjustment to the walls 27*a* of the hoppers 27 and the sides 62, according to the width of the pack 2, irrespective of the relative position and height of the walls 27*a* and sides 62.

At the center of the feed line 50, between the transfer device 60 and the feeder 51, the machine 1 has connecting means which connect the structure of the transfer device 60 to the end of the arm 51*b*. In particular, these connecting means comprise a vertical guide 381 connected to the structure of the transfer device 60 by two cylinders 382 (see FIG. 13*c*) respectively located on either side of the product feed line 50. A bearing 383 attached to the unloading end 51*b* of the feeder 51 is mounted in such a way that it can translate along the guide 381 and constrains the unloading end 51*b* to move vertically during the oscillations of the arm 55 about the plate 56. Activation of the cylinders 382 is controlled by the centralized control means and allows the vertical guide 381 to be moved horizontally away from or towards the transfer device 60 over a preset distance. Such a movement of the arm, in one direction, allows the feeder to be moved away from the transfer device 60 so as to prevent the bars 55*b* of the arm from interfering with the pusher bars 63 of the transfer device 60 during set up or size-changeover operations and, in the other direction, allows the feed line 50 operating cycle conditions to be restored.

Figure 13A:
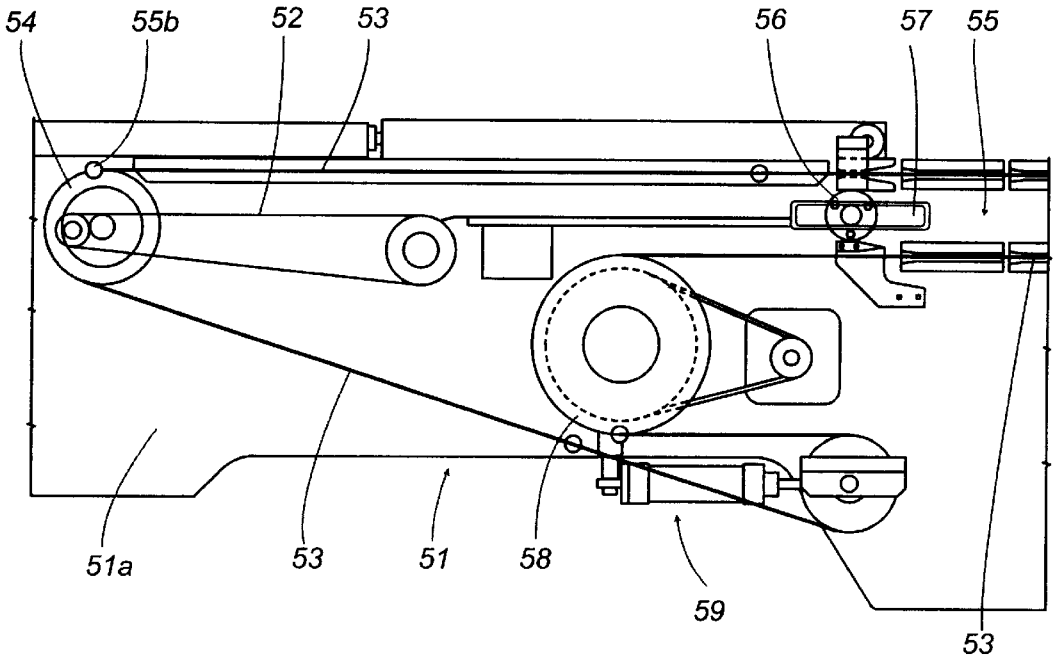
FIGS. 13*a*, 13*b* and 13*c* are scaled-up side views, with some parts cut away to better illustrate others, of some details of the invention.
Figure 13B:
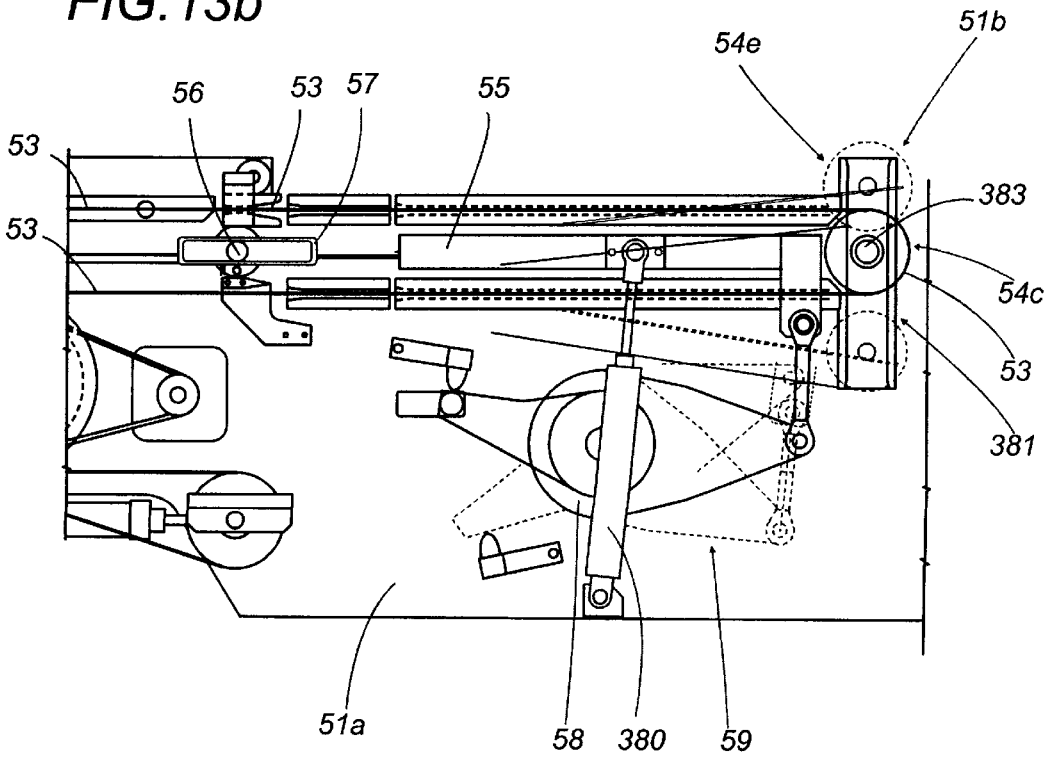
Figure 13C:
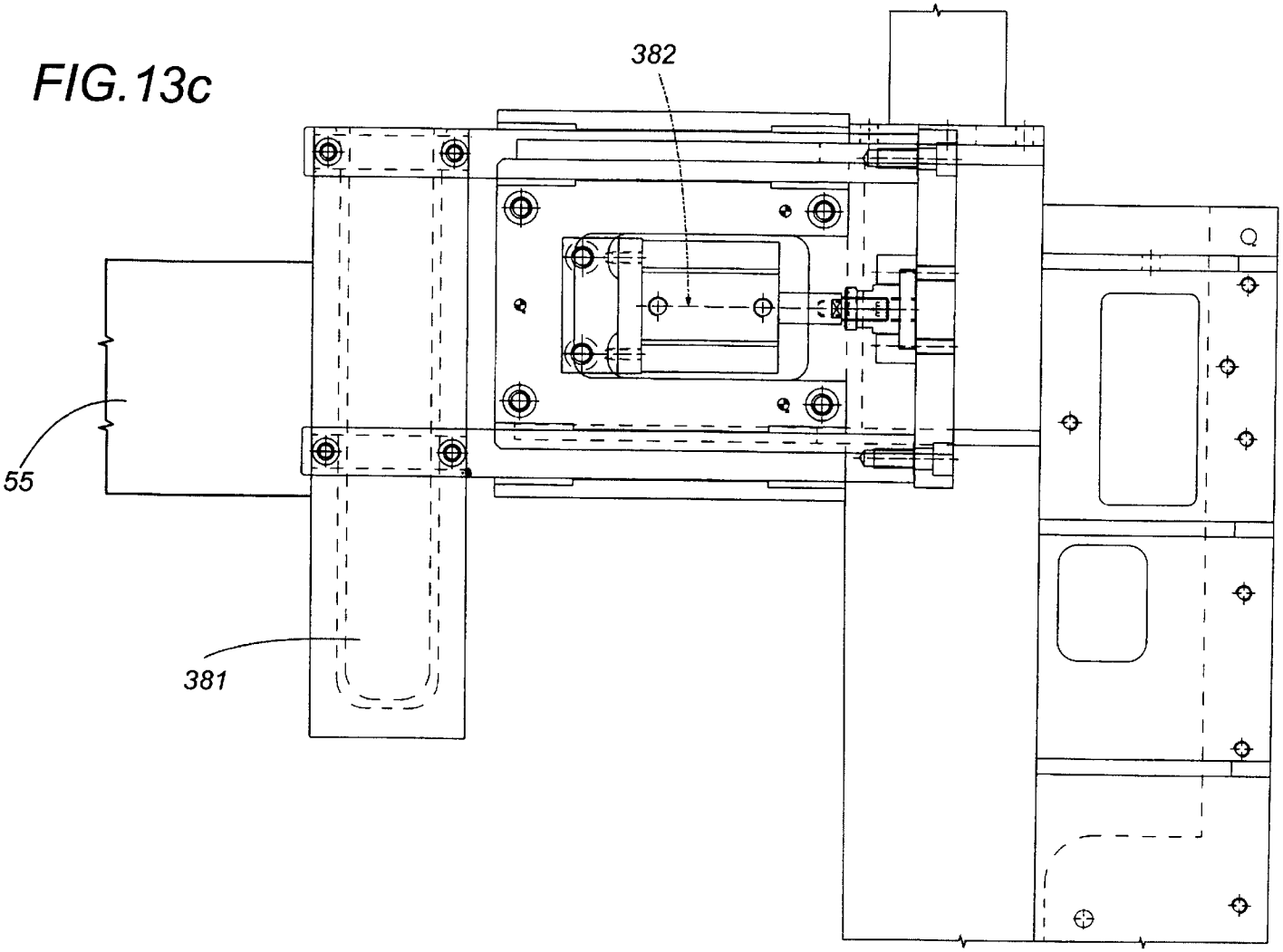
Figure 14:
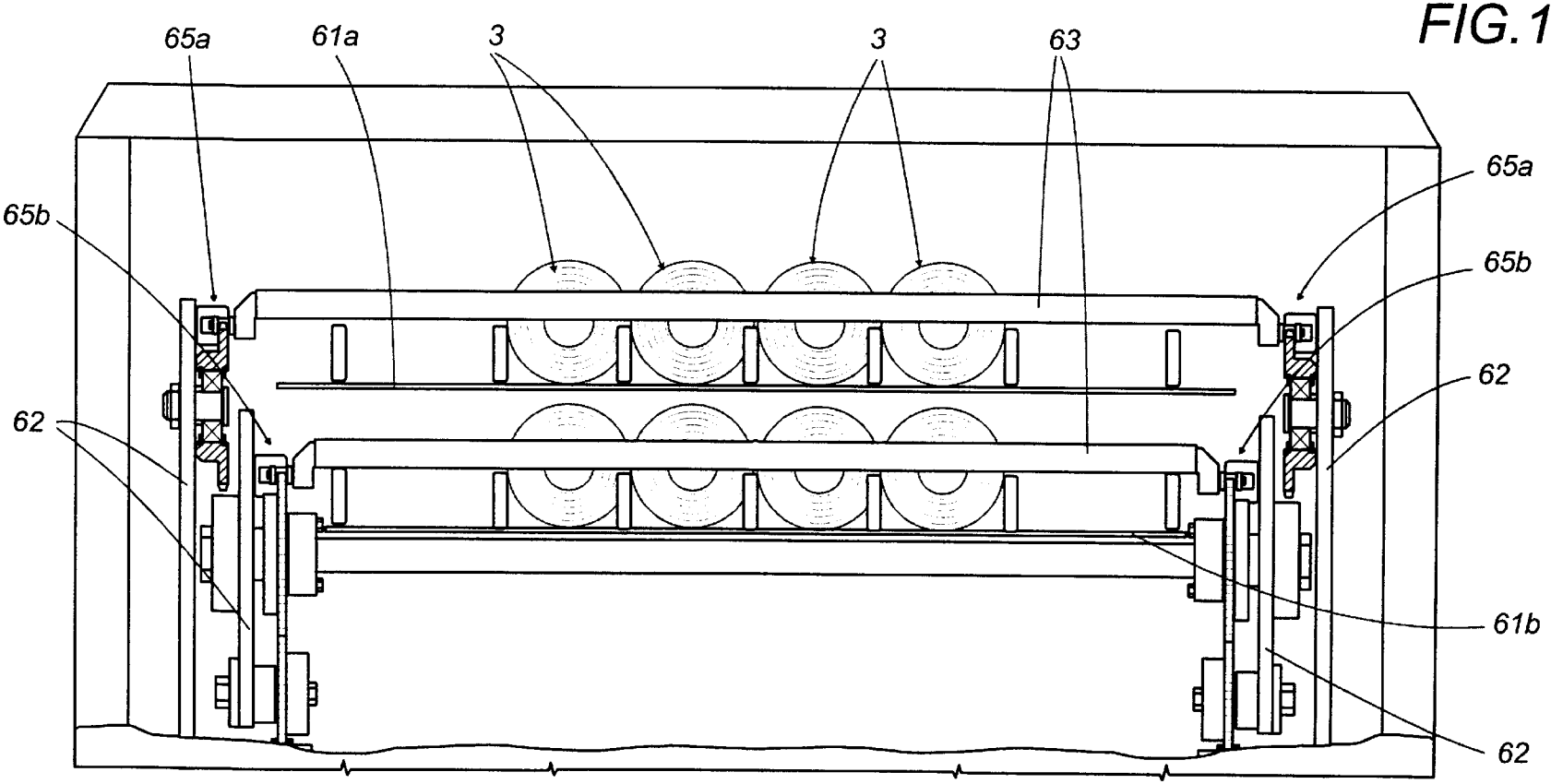
FIG. 14 is a cross-section of a detail of the invention, along line XIV—XIV illustrated in FIG. 1.

In FIGS. 13*a* and 13*b* it can be seen that on the feeder 51, due to the fact that during adjustment the drive means of the chains 53 translate on the plate 56 integral with the arm 55, whatever the extent of the adjustment movement between the feeder 51 and transfer device 60, the timing of the bars 55*b* of the arm 55 is constantly maintained. This means that the product pack size changes can be effected directly with the software of the centralized control means, the advantages being simpler, more rapid adjustment operations.

When the packaging machine 1 is operated, the product feed line 50 prepares the sets of products 3, which may be in layers, that are deposited on the loading table 5*p* of the lift 5.

The products 3 are deposited with a combined translation of the arm 55 of the feeder 51 and the transfer device 60 attached to it. This translation is made possible by the fact that, as indicated above, the feeder 51 and transfer device 60 are supported by a shared carriage, mounted in such a way that it can slide horizontally on a guide supported by a fixed structure on the packaging machine 1 (see FIGS. 13*a*, 13*b*).

This horizontal translation is effected alternately between two end positions, at which the unloading end 60*s* of the transfer device 60 is respectively: in one case, close to the side of the loading table 5*p* of the lift 5 and, in the other case, above the loading table 5*p* and near the center line of the lift 5 (see FIG. 2).

It should be noticed that the positioning of the unloading end 60*s* above the loading table 5*p* of the lift 5 has the advantage of allowing the products, layered or not, to be deposited without the layers of products 3 positioned above one another sliding relative to each other.

As regards adjustment of the feeder 60 of the feed line 10, it should be noticed that this adjustment refers to the product sliding surface 9 in terms of its vertical positioning relative to the surface 9. In other words, the adjustment is ideally made by keeping the position of the top of the product 3 fixed, so that the top remains constantly equidistant from the sheet of wrapping material in the positioning device 105. In contrast, the base of the product 3 varies according to the size of the products 3 being packaged. The lower layer of products 3 in a pack 2 to be formed is, therefore, forced to converge upwards, so that the top of the lower product is at a point immediately below the upper product, then the two layers are aligned. This alignment occurs during the final stage of product feed, when the transfer surfaces 61*a*, 61*b* place both layers on the loading table 5*p* of the lift 5.

Such a set-up has allowed the end of the feed line 10 (corresponding to the transfer device 60) to be shortened and, therefore, a reduction in the length of the chains. The advantage of this is that there are fewer pusher bars 63, allowing a reduction in bar 63 assembly times when this operation is required.

It should also be noticed that the mounting of the feeder 51 and transfer device 60 on a shared carriage allows the carriage to be driven vertically by brushless electronic motors, said movement controlled by the packaging machine 1 control means so as to align the unloading end 60*s* of the feed line 50 with the loading table 5*p* of the lift 5. In other words, the height of the feed line 50 is also adjusted by lowering the unloading end 60*s* relative to the product sliding surface 9.

Figure 15A:
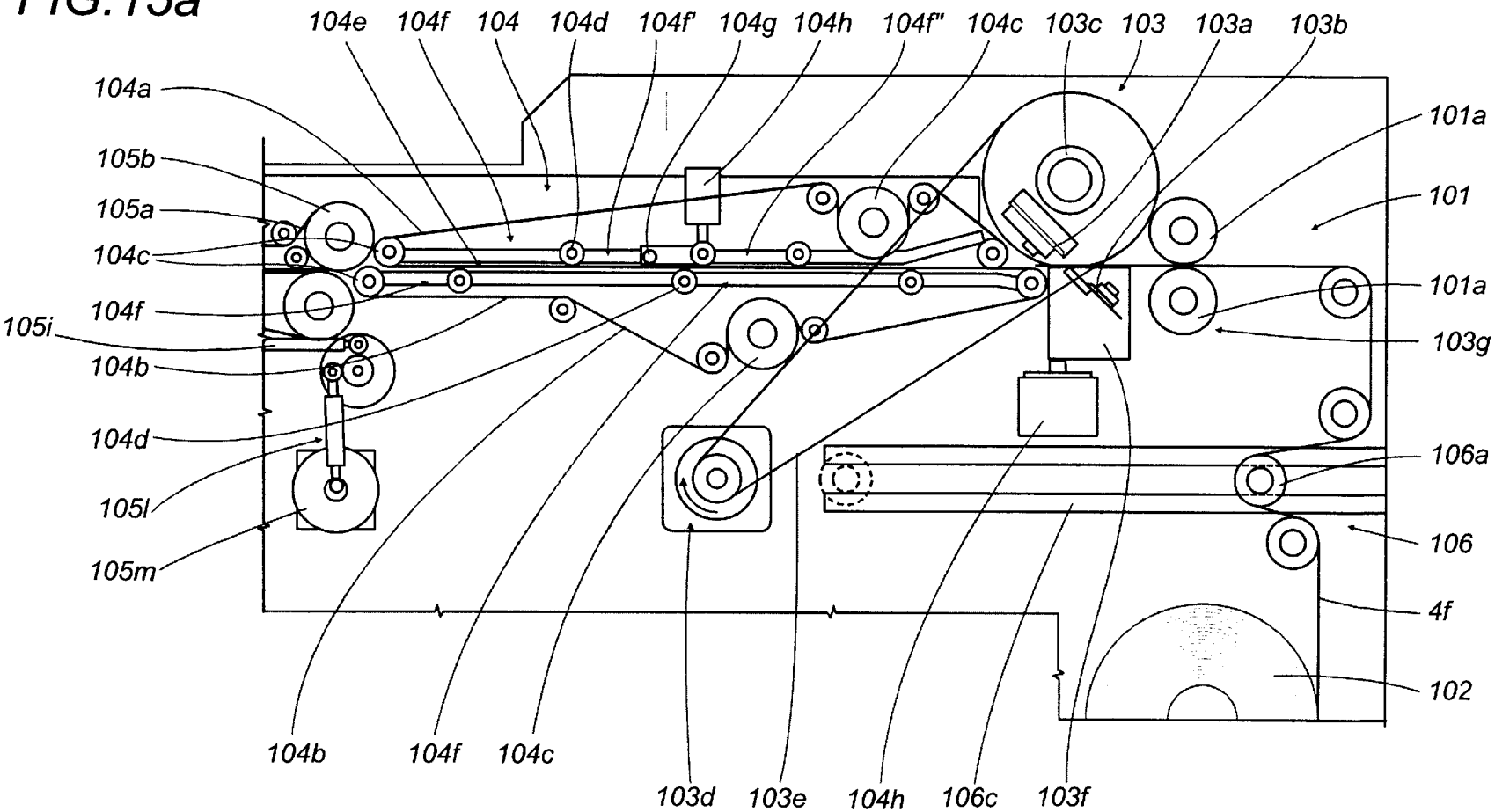
FIGS. 15*a* and 15*b* are, respectively, scaled-up elevation views of a wrapping material feed line fitted on the machine.
Figure 15B:
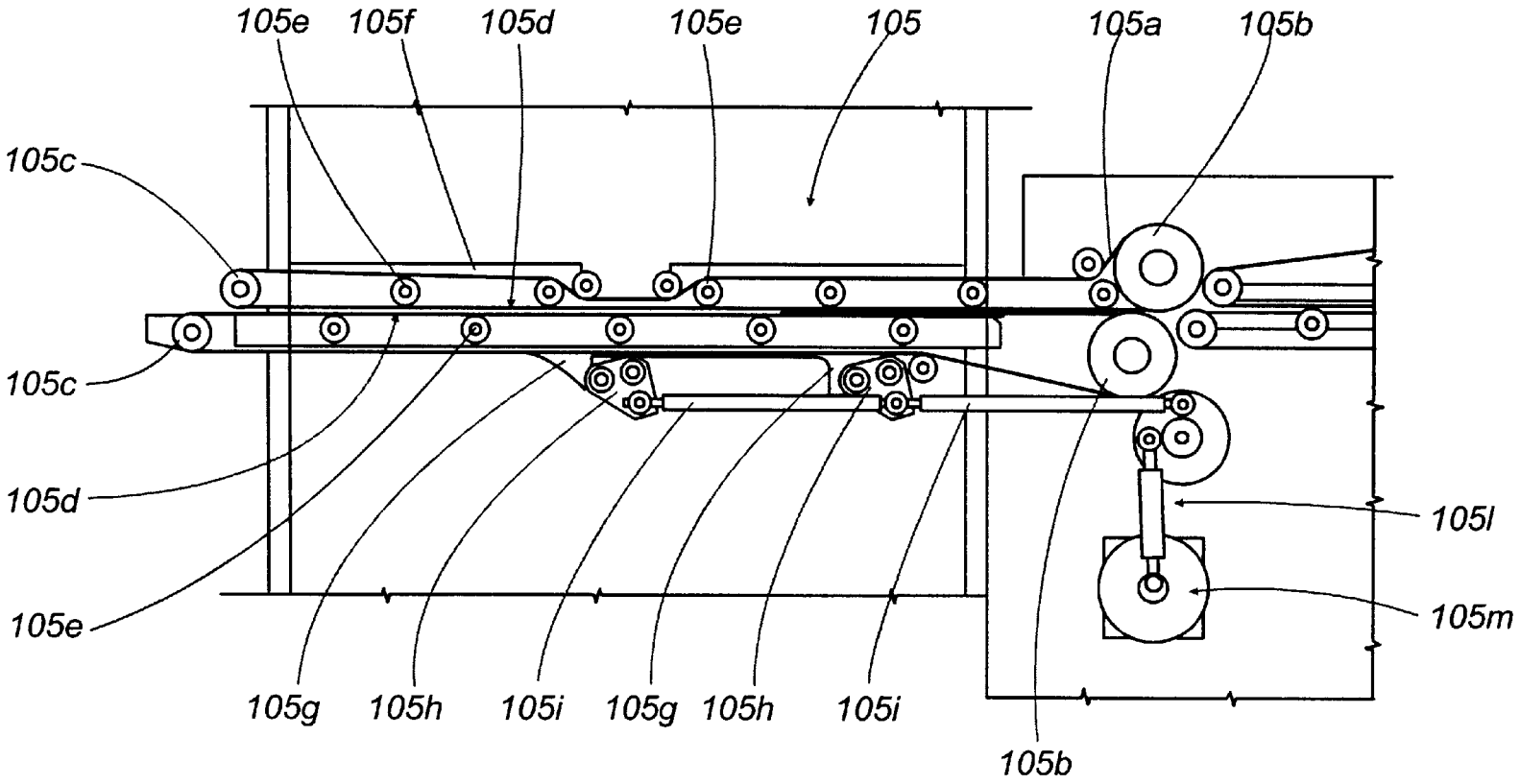

As regards the film feed line 100, FIG. 1 shows that it is positioned on the side of the machine casing 15 opposite that of the product feed line 50 and basically comprises (see FIG. 15*a*) a unit 101 for unwinding a plastic film 4*f* from a reel 102, a cutting device 103, a transfer device 104 and a positioning device 105 (see FIG. 15*b*).

The unwinding unit 101 comprises a pair of unwinding rollers 101*a*, supported on either side of the film 4*f*, in contact along one of their generatrices and motor-driven so as to impart to the film 4*f* a forward movement which gradually unwinds the film 4*f* from the reel 102. A photocell 101*b* is attached to the unwinding unit 101, upstream of the unwinding rollers 101*a*, to allow the reading of several control references stamped on the film 4*f* unwound from the reel 102 for the length control. The unwinding rollers 101*a* are preferably driven by a brushless electronic motor, controlled by the machine 1 centralized, main control means so that it is activated for the time necessary to unwind a preset length of film 4*f*, the length being detected by the photocell 101*b*.

Between the unwinding rollers 101*a* and the reel 102, the unwinding unit 101 comprises controlled film 4*f* tensioning means 106 which, in particular, comprise an idle roller 106*a* (dandy roller) supported by a linear actuator, represented for example by a pneumatic cylinder, and housed in such a way that it can slide in a linear guide 106*c*.

The movements of the idle roller 106*a* along the guide 106*c* are potentiometrically controlled, so that the film 4*f* tensioning can be modulated from the program by the machine 1 control means according to the physical and geometric characteristics of the film 4*f* used.

The cutting device 103 comprises two cutters 103*a*, 103*b* comprising blades angled transversally to the film 4*f*, on either side of the latter, one of which has a segmented cutting edge. A first cutter 103*a* is supported by a support roller 103*c*, which rotates about its own axis driven by a brushless electronic motor 103d which drives the roller 103*c* by means of a belt drive 103*e*. The second cutter 103*b* is supported tangential to the cutting plane of the first cutter 103*a* by a support 103*f*.

The support 103*f* supports the second cutter 103*b*, with elastic means inserted between the two. Said elastic means allow more gradual cutting, thus extending the working life of the cutting edge of the cutter 103*a*, 103*b* edges.

The support 103*f* for the second cutter 103*b* is attached to the machine 1 structure by a fixed hinge 103*g* and two pistons 104*h* which, when operated, allow the second cutter 103*b* to be moved towards or away from the first cutter 103*a*, in order to adjust the relative positions necessary for some machine 1 adjustments.

During operation, the cutting device 103 makes discontinuous cuts in the film 4*f*, creating a tear line which, although maintaining film 4*f* continuity, allows sheets of a predetermined size to be torn from the film at the appropriate time.

As regards adjustment of the cutting device 103, in terms of a variation in the distance between two consecutive tear lines, FIG. 15*a* clearly shows that this is easily controlled by the machine 1 centralized, main control means, creating a controlled correlation between the speed of rotation of the first cutter 103*a* and the feed speed of the film 4*f* being unwound.

The transfer device 104 comprises two opposite conveyors with respective motor-driven belts 104*a*, 104*b*, wound around pulleys 104*c* to form an elongated loop along the film 4*f*.

The belts 104*a*, 104*b* have transfer branches 104*e* which clamp both sides of the film 4*f* between them, feeding it from an infeed zone, near the cutting device 103, to an outfeed zone, near the positioning device 105.

The transfer branches 104*e* of the individual belts 104*a*, 104*b* are counteracted from the inside of the respective loop configurations by a set of presser rollers 104*d* supported by supports 104*f*.

The presser rollers 104*d* are staggered longitudinally to the film 4*f* and are mounted in such a way that they make contact orthogonally with the branches 104*e*, so as to impart to the film 4*f* an undulating longitudinal form, which promotes film 4*f* drawing by friction.

The support 104*f* of the presser rollers 104*d* of one of the belts 104*a* is divided into two parts 104*f*', 104*f*" connected together by a reciprocal joint 104*g* and a piston 104*h* controlled by the machine 1 centralized control means.

The positioning device 105 (see FIG. 15*b*) extends downstream of the transfer device 104 and across a machine 1 vertical frame, located between the forming line 10 and the lift 5.

Said positioning device 105 comprises two opposite motor-driven belts 105*a*, wound around pulleys 105*b* and forming elongated horizontal loops along the film 4*f*. The belts 105*a* have opposite transfer sections 105*d*, pressed against one another on either side of the film 4*f* by presser rollers 105*e*, so as to transfer the film horizontally until it reaches the lift 5 vertical axis. The belts 105*a* are motor-driven, so that they have a speed tangential to the film 4*f* which is significantly higher than the speed of the film 4*f* along the transfer device 104.

The rollers 105*a* of one of the belts 105*a*, in particular the lower belt 105*a*, are supported by a connecting rod 105*g* of a first four-bar linkage which has rocker arms 105*h* connected in such a way that they can rotate, respectively to the connecting rod 105*g* and to the frame. The rocker arms 105*h* of the first linkage are moved at an angle by rods 105*i* moved by a second four-bar linkage 105*l*, in turn driven by an electronic motor 105*m*, preferably of the brushless type, controlled by the machine 1 general control means. During operation, the positioning device 105 allows sheets delimited by two consecutive tear lines to be torn from the film 4*f*, at the zones of the film 4*f* which gradually come to be simultaneously held by the belts 104*a*, 104*b* of the transfer device 104 and the belts 105*a*, 105*b* of the positioning device 105.

In this condition, the piston 104*h* is activated or disabled by the centralized control means, so as to allow a sheet to be torn from the film 4*f* only at the predetermined position, depending on the position, downstream or upstream of the piston 104*h*, assumed by the tear line in the various pack sizes.

After each sheet torn from the film 4*f* has reached its final position on the lift 5 vertical axis, the positioning device 105 motor is stopped. Then, activation of the motor of the second four-bar linkage 1051 moves the lower belt 105*b* of the positioning device 105 away from the upper belt 105*a* and the sheet, released by the belts 105*a*, 105*b*, is intercepted by the pack of products raised by the lift 5, extracted from the positioning device 105 and transferred together with the products to the machine 1 first operating station 6 above.

Operation of the packaging machine 1 may be described starting from an initial configuration, in which (see FIG. 5*a*) the lift 5 loading table 5*p* is lowered relative to the horizontal product sliding surface 9 by a height H (see FIG. 5*c*), closely correlated with the height of the pack 2 of products (illustrated by way of example, but without limiting the range of configurations, by two layers of products placed one on top of the other), a height which is detected along the direction of the reference axis Y in FIG. 4, starting from the sliding surface 9.

In this condition, after the product feed line 50 has deposited the products on the lift 5 loading table 5*p*, the lift 5 is raised until its loading table 5*p* is aligned with the product sliding surface 9. During the lift 5 upstroke from the lowered level to the raised level, the products intercept a sheet of wrapping material standing by in the positioning device 105 and are placed on the sliding surface 9 of the feed line 10, between the pusher means 19 of the closed-loop transfer device 18. Meanwhile, the sheet of wrapping material lies on top of the products 3 (see FIG. 5*b*) and hangs down on both sides of the products with its vertical folds positioned between the products 3 and the pusher elements 19.

When the products 3 have reached the first operating station 6 (see FIG. 5*b*), the lift loading table 5*p* external elements 5*p*' descend again, whilst the central element 5*p*" maintains its position, supporting the products 3 together with the pusher elements 19.

In this condition, the horizontal-plane folder 11 and counter-folder 12, located below the sliding surface 9, are moved from a first, open, end position (in which they were positioned to allow the transit of the loading table 5*p* of the lift 5 towards the product 3 sliding surface 9), to a second, closed, end position, in which the products 3 are gradually loaded onto them and they support the products on the sliding surface 9, whilst the central element 5*p*" of the loading table 5*p* in turn begins to move towards the lift 5 lowered position.

As the folder 11 and counter-folder 12 move towards one another, the opposite edges of the sheet, hanging down vertically from the pack 2, are gradually intercepted by the folder 11 and counter-folder 12, which cause them to overlap underneath the products 3.

As the folder 11 and counter-folder 12 move towards one another, two pairs of vertical-plane folders 13, 14, parallel with one another and with the forming line 10, located on either side of the products at a distance corresponding to the pack depth and mobile opposite one another, are moved from a non-operating end position in which they are outside the pack width dimension, towards a closed, operating position.

In the closed, operating position, the vertical-plane folders 13, 14 intercept the vertical edges of the sheet at the faces of the pack parallel with the forming line 10 and fold them about vertical fold lines, forming pairs of first, vertical flaps 13*v*, which are pressed against the products 3 and pairs of second, horizontal flaps 13*o*, on either side of the vertical-plane folders 13, 14.

A further forward movement along the sliding line 9, imparted to the products 3 by activation of the pusher elements 19, brings the products to the second operating station 7 (see FIG. 5*e*). Here, the two pairs of fixed helical folders 16, 17 located on either side of the feed line 10 and at a distance from one another: vertically, according to the height of the pack 2 of products, and horizontally according to the depth of the pack 2, gradually fold the second flaps 13*o* until they overlap the sheet of wrapping material on the top and bottom of the pack 2 against the products 3.

The first sealing means 180 then intervene, sealing the overlapping edges of the sheet of wrapping material underneath the pack.

A further movement of the pusher elements 19 brings the products to the third operating station 8, where second sealing means definitively seal the first and second flaps to the sheet of wrapping material.

The present invention fulfils the aim of allowing product 3 pack 2 size adjustments referenced directly or indirectly solely to the product 3 sliding surface 9. Such a set-up allows automated, centralized control of the machine 1 and the relative size adjustments, a control which can be obtained by operating almost exclusively via software directly from the machine 1 centralized control means. Such a construction design is made particularly simple by the fact that, as indicated above, all actuator means which drive the machine 1 moving parts preferably comprise brushless electronic motors.

However, such a design concept also encompasses alternative embodiments and modifications which may be the result of a more strictly mechanical machine 1 set-up.

Figure 16:
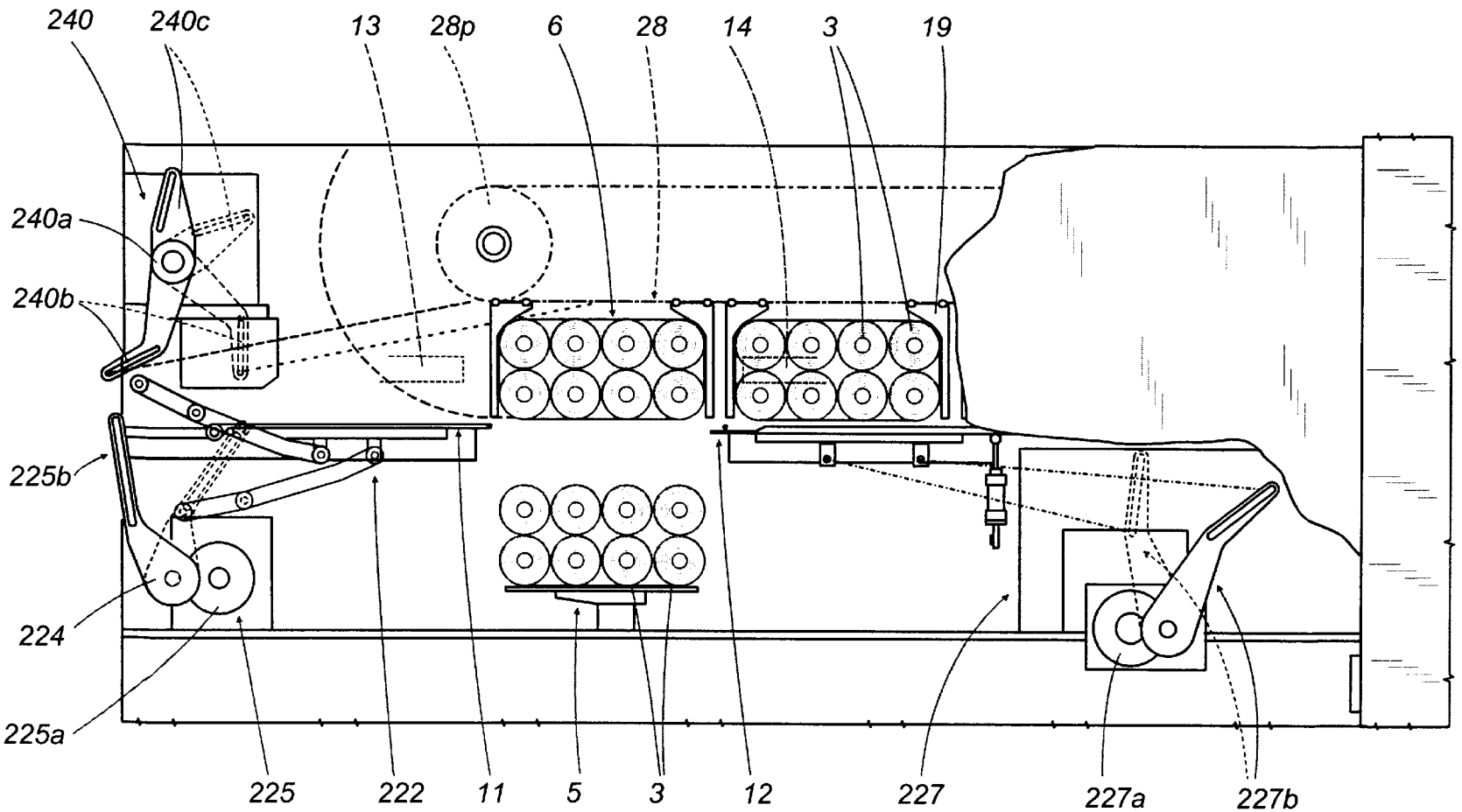
Figure 16A:
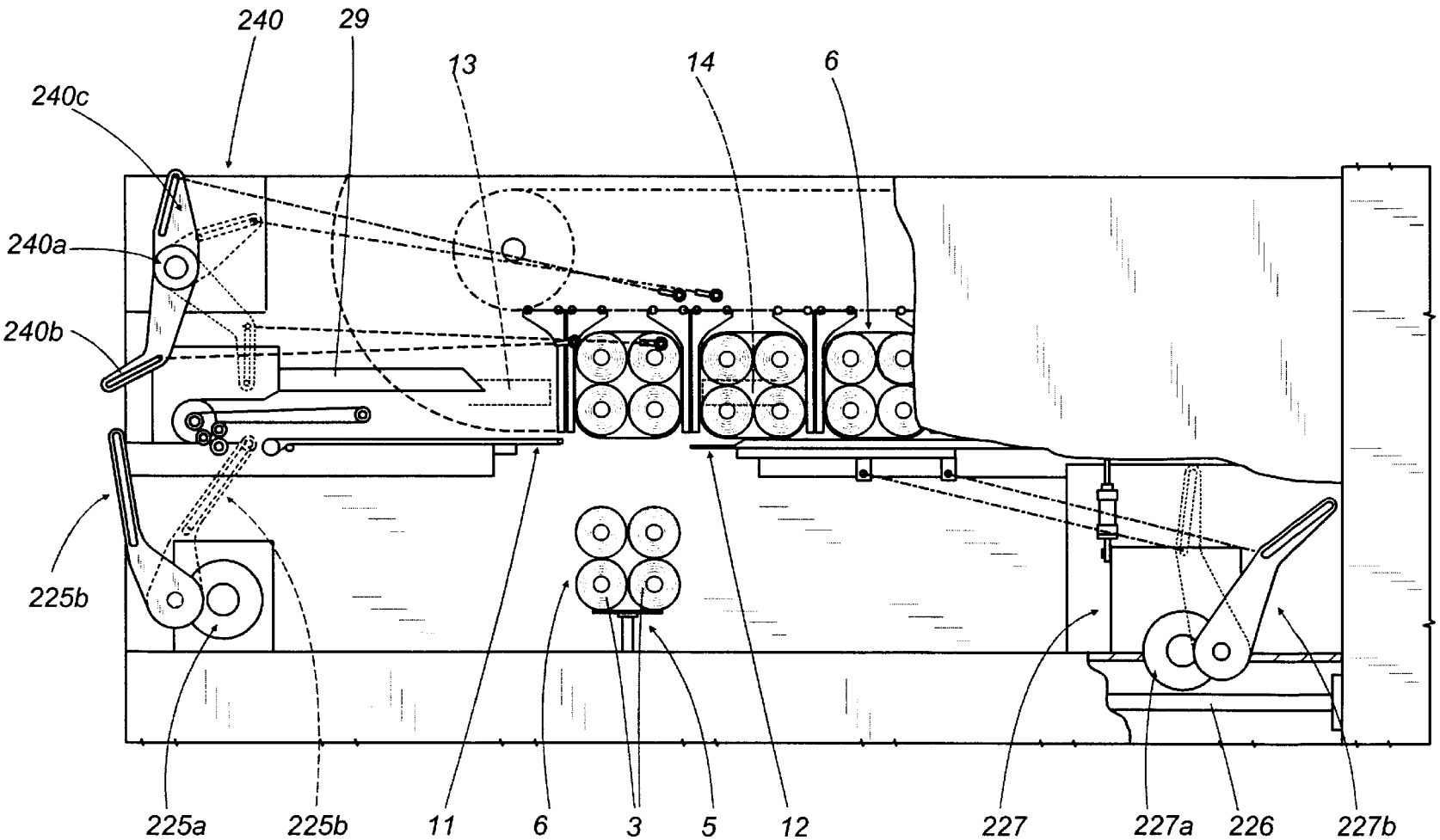

One such alternative embodiment is illustrated, by way of example and without limiting the scope of application, in FIGS. 16, 16*a* and 17, in which it can be seen in particular that the actuator means of the moving parts on the machine 1 may be driven by a single main motor-driven shaft 226 extending through the machine 1 longitudinally below the machine casing 15.

In this case, the main shaft 226 is driven by mechanical belt or chain drives 225, 227 connected to gearings 225*a*, 227*a* which drive linkages 225*b*, 227*b* connected to the horizontal-plane folder 11 and counter-folder 12.

The main shaft 226, again through a flexible element drive 240 (belt or chain), drives a gearing 240*a* located at one end of the machine 1 casing 15. Said gearing 240*a* simultaneously drives both pairs of vertical-plane folders 13, 14 by simultaneously driving two crankshafts 240*b*, 240*c* belonging to two separate linkages, one of which drives a first pair of folders 13, 14 and the other driving a second pair of vertical-plane folders 13, 14 immediately adjacent along the forming line 10.

Figure 17:
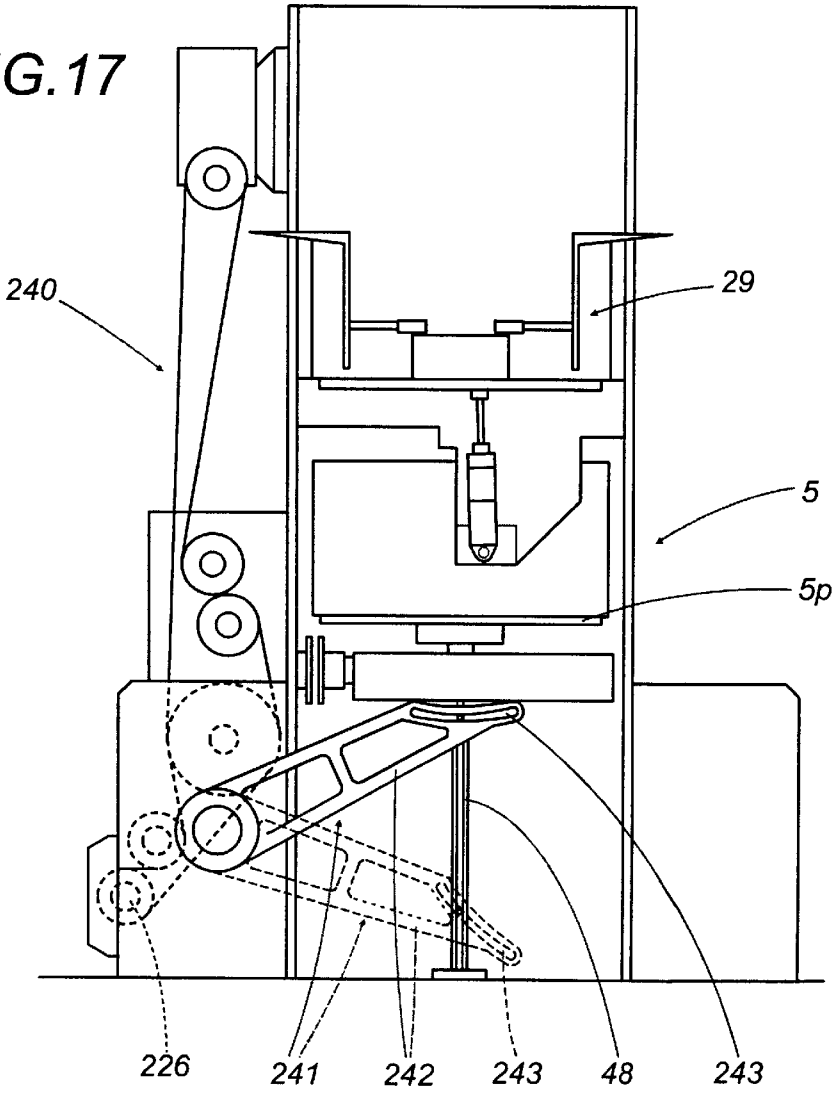
FIGS. 16, 16*a* and 17 are, respectively, two elevation views and a cross-section, with some parts cut away to better illustrate others, of an alternative embodiment of the machine illustrated in the previous figures.

As regards the lift 5, FIG. 17 shows that being driven by the main shaft 226, it is possible to operate in a similar way to that described above, driving the lift 5 loading table 5*p* with a third linkage 241 which has an arm 242 that oscillates alternately in the vertical plane, one end of the arm interconnecting with the rod 48 of the lift 5 loading table 5*p* at a suitably shaped end slot 243.

What is claimed:

1. An automatic packaging machine for packaging products in packs comprising: a wrapper forming line, said line having a succession of at least three operating stations above a sliding surface along which the products are fed with a stepping motion by mobile pusher elements; a forming line in which a first operating station co-operates with a lift, the lift being positioned below the product sliding surface and being vertically and alternately mobile between a lowered position, in which it receives the products on its loading table and a raised level, in which it places the products on the sliding surface of the forming line, feeding them between the pusher elements with a sheet of wrapping material laid on top of the products and hanging down on either side of them, its vertical folds between the products and the pusher elements; the first operating station also comprising a horizontal-plane folder and counter-folder, located below the sliding surface and on either side of the lift, said folder and counter-folder being alternately and relatively mobile parallel with the sliding surface between a first, open, end position, in which they allow the transit of the lift loading table towards the product sliding surface, and a second, closed, end position, in which they are brought together in such a way as to gradually take the products from the loading table, supporting them on the sliding surface and simultaneously wrapping the opposite edges of the sheet around the products until they overlap underneath the products; said first operating station also comprising two pairs of vertical-plane folders, parallel with one another and with the forming line, being positioned on either side of the products at a distance corresponding with the pack depth and being alternately mobile opposite one another between a non-operating end position, in which they are located outside the pack width dimension, and a closed, operating position, reached as they intercept the vertical edges of the sheet, folding them to form pairs of first, vertical flaps which are pressed against the products, and pairs of second, horizontal flaps, the latter being on either side of the vertical-plane folders; a second operating station comprising two pairs of fixed folders, being located on either side of the forming line and distanced from one another vertically according to the product pack height and horizontally according to the pack depth, said fixed folders having helical surfaces extending longitudinally to the forming line to gradually fold the second flaps until they overlap the sheet of wrapping material, pressing them against the products; there being sealing means for sealing the overlapping edges of the sheet of wrapping material underneath the pack and the first and second flaps on the sheet of wrapping material, the machine being characterized in that it comprises adjustment means at least for the wrapper forming line, said means being operatively connected to machine centralized control means and being designed to refer the machine adjustments necessary for pack size variations to the product sliding surface.

2. The machine according to claim 1, comprising a support structure for the horizontal-plane folder, said structure translating alternately relative to the machine fixed structure when corresponding actuator means are activated, wherein the actuator means comprise a linkage including a connecting rod, one end of which is jointed to the folder support structure and the other end is connected to a motor-driven crankshaft, said adjustment means comprising a motor which drives the crankshaft, controlled by machine centralized, main control means according to the pack size detectable longitudinally to the wrapper forming line.

3. The machine according to claim 2, wherein the motor which drives the crankshaft is a brushless electronic motor.

4. The machine according to claim 1, wherein a support structure for the horizontal-plane counter-folder translates alternately relative to the machine fixed structure when corresponding actuator means are activated, and wherein the actuator means comprise a linkage including a connecting rod, one end of which is jointed to the counter-folder support structure and the other end is jointed to a motor-driven crankshaft, said adjustment means comprising an electronic motor which drives the crankshaft, the motor being controlled by machine centralized, main control means according to the pack size detectable longitudinally to the wrapper forming line.

5. The machine according to claim 1, wherein the folder and counter-folder are simultaneously mobile relative to the product sliding surface and reach the closed position at an end of stroke point, said point being located a given distance downstream of a vertical center line of the first operating station, along the wrapper forming line.

6. The machine according to claim 5, wherein the distance is approximately 70 mm.

7. The machine according to claim 1, wherein the folder and counter-folder are supported in such a way that they are horizontally offset below the first operating station, allowing access to the machine in the areas below and to the sides of the first operating station.

8. The machine according to claim 1, comprising a hopper between the first operating station and the lift, wherein the hopper has at least one vertical wall, said wall translating horizontally when corresponding actuator means, controlled by the machine centralized control means, are activated, in such a way that it may be positioned at a variable distance from a vertical center line of the first operating station depending on the size of the pack.

9. The machine according to claim 8, wherein said wall or walls of the hopper are horizontally supported in such a way that they are offset and guided by a structure on the machine.

10. The machine according to claim 8, wherein said wall or walls of the hopper have actuator means controlled by the machine centralized control means.

11. The machine according to claim 10, wherein said actuator means comprise a rod which is integral with the wall or walls of the hopper, having teeth which engage with a motor-driven sprocket when the relative command is issued by the machine centralized control means.

12. The machine according to claim 1, wherein the lift has actuator means which drive its mobile loading table, the height of said means being adjustable relative to the product sliding surface between the operating stations.

13. The machine according to claim 12, in which the lift comprises vertically translating guide rods for a lift table, wherein said actuator means comprise at least one linkage including a connecting rod and a crankshaft jointed to one another and respectively connected to one of the rods and to a motor, said motor being controlled by the machine centralized control means.

14. The machine according to claim 13, wherein the motor is a brushless electronic motor.

15. The machine according to claim 12, in which the lift comprises a table with elements which are separately mobile, wherein the elements are driven with variable movement sequences when the relative command is issued by the machine centralized control means.

16. The machine according to claim 12, wherein the stroke of the mobile table may be adjusted relative to the variations in product pack size, according to the lowering of the table relative to the product sliding surface.

17. The machine according to claim 1, wherein the vertical-plane folders are driven by corresponding actuator means with synchronized motion and in opposite directions, reaching a position in which they are closest to one another at a point that is downstream of a vertical center line of the first forming station and is translated by a given distance relative to said-line.

18. The machine according to claim 17, wherein said actuator means comprise at least one linkage including a connecting rod and a crankshaft, being jointed to one another and respectively connected to a vertical-plane folder, said linkage being connected to at least one motor which is controlled by the machine centralized control means.

19. The machine according to claim 18, wherein the motor or motors are of the brushless electronic type.

20. The machine according to claim 18, wherein the linkage or linkages have ball joints designed to allow the linkages to adapt automatically to the variations in the distance between the vertical-plane folders correlated to the variations in the size of the pack.

21. The machine according to claim 17, wherein the vertical-plane folders are supported by machine side frames, it being possible to adjust them horizontally and vertically relative to the forming line sliding surfaces.

22. The machine according to claim 21, wherein the side frames are connected to first carriages, the latter sliding horizontally with synchronized motion and in opposite directions when a worm screw is activated, said screw being driven by a motor controlled by the machine centralized control means.

23. The machine according to claim 22, wherein there is a single worm screw, having opposite threads engaging with the carriages and, when the screw turns, allowing the simultaneous movement of the side frames towards or away from the forming line.

24. The machine according to claim 21, wherein the vertical-plane folders are connected to second carriages, the latter sliding in guides in a vertical direction when the relative command is issued by the machine centralized control means, allowing adjustment of the vertical-plane folders relative to the sliding surface, depending on the height of the pack.

25. The machine according to claim 1, in which the sealing means comprise a sealing bar supported across the forming line and supported by a system of parallel rods, one end of the rods being jointed to the sealing bar and the other to the machine structure, wherein the sealing bar is attached to one end of a connecting rod of variable length, the other end being connected to a motor-driven cam which rotates when the relative command is issued by the machine centralized control means.

26. The machine according to claim 25, wherein the connecting rod of variable length is controlled by the machine centralized control means, lowering the sealing bar below the forming line sliding surface at least when the machine is in emergency condition.

27. The machine according to claim 26, wherein the connecting rod is driven by a piston, the piston rod and cylinder being connected to the sealing bar and to the cam.

28. The machine according to claim 1, wherein the third operating station is supported in such a way that it is horizontally offset by the machine casing.

29. The machine according to claim 1, comprising a film feed line equipped with an unwinding unit, a cutting device, a transfer device and a positioning device, being positioned in succession on a section of film unwound from a reel, wherein the unwinding unit comprises a pair of motor-driven unwinding rollers, the latter being attached to the film, and a photocell, being attached to the unwinding unit, allowing the reading of control references attached to the film unwound from the reel, the rollers being controlled by the machine centralized control means in such a way that they are activated for the time required to unwind a preset length of film, said length being read by the photocell.

30. The machine according to claim 29, wherein the unwinding rollers are driven by actuator means comprising a brushless electronic motor controlled by the machine centralized control means.

31. The machine according to claim 29, wherein the unwinding unit comprises controlled film tensioning means, said means having a film idle roller supported by a linear actuator, the movements of the latter being potentiometrically controlled by the machine centralized control means according to the characteristics of the film used and the degree of tensioning desired.

32. The machine according to claim 29, in which the cutting device comprises two cutters angled transversally to the film, a first cutter being supported by a roller which rotates about its own axis, the second cutter being supported by a relative support, wherein the first cutter is mobile when actuator means controlled by the centralized control means are activated, variably correlating the speed of rotation of the first cutter with the feed speed of the film being unwound.

33. The machine according to claim 32, wherein said actuator means comprise a brushless electronic motor for driving the first cutter.

34. The machine according to claim 29, wherein the support holds the second cutter, there being elastic means between said support and cutter which allow cutting of the film to be effected in a more gradual manner.

35. The machine according to claim 34, wherein the support of the second cutter is attached to the machine structure by a fixed hinge and at least one piston, activation of said piston allowing the second cutter to be moved towards or away from the first cutter, in order to adjust their relative positions.

36. The machine according to claim 29, in which the positioning device comprises two belts wound around pulleys and forming elongated horizontal loops along the film, having opposite transfer sections, pressed against one another on either side of the film by presser rollers, wherein the rollers of at least one of the belts are supported by a connecting rod of a first four-bar linkage, the latter having rocker arms connected in such a way that they can rotate, respectively to the connecting rod and to the machine structure, the rocker arms of the first linkage being moved at an angle by rods moved by a second four-bar linkage which is motor-driven and controlled by the machine centralized control means.

37. The machine according to claim 34, wherein the second four-bar linkage is driven by a brushless electronic motor.

38. The machine according to claim 1, wherein there is at least one centralized drive shaft, there being a plurality of mechanical drives connected to and driven by the drive shaft, said mechanical drives transmitting motion to the horizontal-plane folders, the vertical-plane folders, the pusher elements and the machine lift.

39. The machine according to claim 38, wherein the drives are attached to gearings which drive the linkages that drive the horizontal-plane folders, the vertical-plane folders, the pusher elements and the machine lift.

40. The machine according to claim 1, wherein there is a feed line for the products to be packaged, it being possible to adjust the height of said line relative to the product sliding surface between the operating stations.

41. The machine according to claim 39, wherein the product feed line has a horizontally mobile transfer device and a telescopic feeder for feeding the products onto the lift loading table.

42. The machine according to claim 41, wherein the transfer device has two overlapping transfer surfaces, it being possible to adjust the latter vertically relative to the product sliding surface between the operating stations.

43. The machine according to claim 25, wherein the machine centralized control means activate the sealing bar drive means in such a way that the time required for sealing is independent of the speed of the forming line.

44. The machine according to claim 41, wherein the feeder has a telescopic arm jointed to a fixed support structure and wherein reaction means are envisaged between the fixed structure and the arm, being designed to counteract the rotation of the arm relative to the fixed structure due to the weight of the arm.

45. The machine according to claim 44, wherein the reaction means comprise at least one pneumatic cylinder, its compressed air supply being controlled by the centralized control means.

46. The machine according to claim 41, wherein the transfer device has sides connected to the walls of the hoppers by adjustment means, the latter being controlled by the machine centralized control means in such a way as to impart to the walls of the hoppers and the sides an automatic and simultaneous adjustment according to the width of the pack size, irrespective of the relative position and height of the walls and sides.

47. The machine according to claim 46, wherein the adjustment means comprise rigid rods, the latter being attached with cardan joints and connecting the walls of the hoppers and the sides of the transfer device.

48. The machine according to claim 41, wherein between the transfer device and the feeder there are connecting means which connect the transfer device structure to the end of the feeder.

49. The machine according to claim 48, wherein the connecting means comprise a vertical guide connected to the transfer device structure by two cylinders, said cylinders being positioned on either side of the feed line, and a bearing, the latter being attached to the end of the feeder and mounted in such a way that it can translate along the guide, constraining the end of the feeder to move vertically during the oscillations of the arm on the fixed structure, activation of the cylinders being controlled by the centralized control means and allowing the guide to be moved horizontally away from or towards the transfer device over a preset distance.

* * * * *